US011247807B2

(12) United States Patent
Blundell

(10) Patent No.: US 11,247,807 B2
(45) Date of Patent: Feb. 15, 2022

(54) HEALTHCARE PRODUCT PACKAGE

(71) Applicant: GlaxoSmithKline Intellectual Property Management Limited, Middlesex (GB)

(72) Inventor: Jonathan Blundell, Barnard Castle (GB)

(73) Assignee: GlaxoSmithKline Intellectual Property Management Limited, Middlesex (GB)

( * ) Notice: Subject to any disclaimer, the term of this patent is extended or adjusted under 35 U.S.C. 154(b) by 211 days.

(21) Appl. No.: 16/071,500

(22) PCT Filed: Feb. 9, 2017

(86) PCT No.: PCT/EP2017/052934
§ 371 (c)(1),
(2) Date: Jul. 20, 2018

(87) PCT Pub. No.: WO2017/137522
PCT Pub. Date: Aug. 17, 2017

(65) Prior Publication Data

US 2019/0023447 A1 Jan. 24, 2019

Related U.S. Application Data

(60) Provisional application No. 62/293,911, filed on Feb. 11, 2016.

(30) Foreign Application Priority Data

Feb. 11, 2016 (GB) ..... 1602470

(51) Int. Cl.
*B65D 5/42* (2006.01)
*A61J 1/00* (2006.01)
(Continued)

(52) U.S. Cl.
CPC ..... *B65D 5/4233* (2013.01); *A61J 1/00* (2013.01); *A61J 1/03* (2013.01); *G09F 3/00* (2013.01);
(Continued)

(58) Field of Classification Search
CPC ..... B65D 5/4233; B65D 65/14; A61J 1/00; A61J 1/03; A61J 1/035; A61J 1/10; G09F 3/00
(Continued)

(56) References Cited

U.S. PATENT DOCUMENTS 3,076,541 A 2/1963 Volckening
4,974,983 A * 12/1990 Givati ..... B42D 12/00 150/147
(Continued)

FOREIGN PATENT DOCUMENTS

DE 20021412 U1 5/2002
EP 0246840 A1 11/1987
(Continued)

*Primary Examiner* — Rafael A Ortiz
(74) *Attorney, Agent, or Firm* — Robert J. Smith

(57) ABSTRACT

A healthcare product package (10) comprises a container (2) for containing a healthcare product and an information unit (1) which is located inside the container. The information unit (1) comprises a carrier (3), for instance a base card, and at least one information article (4, 6, 8) attached to the carrier (3).

26 Claims, 11 Drawing Sheets

(51) Int. Cl.

| | |
|---|---|
| ***G09F 3/00*** | (2006.01) |
| ***A61J 1/03*** | (2006.01) |
| ***B65D 65/14*** | (2006.01) |
| *B65C 3/06* | (2006.01) |
| *B65C 9/20* | (2006.01) |

(52) U.S. Cl.
CPC ..... *A61J 2205/30* (2013.01); *B65C 3/06* (2013.01); *B65C 9/20* (2013.01); *B65D 65/14* (2013.01)

(58) Field of Classification Search
USPC ..... 206/232, 534, 223; 383/81
See application file for complete search history.

(56) References Cited

U.S. PATENT DOCUMENTS

| | | | | |
|---|---|---|---|---|
| 5,127,676 | A | 7/1992 | Bockairo | |
| 5,263,743 | A | 11/1993 | Jones | |
| 5,458,374 | A | 10/1995 | Vijuk et al. | |
| 5,884,770 | A * | 3/1999 | Galm | B42D 15/042 206/575 |
| 6,270,121 | B1 | 8/2001 | Dolan et al. | |
| 6,273,260 | B1 * | 8/2001 | ColDepietro | A61J 1/035 206/459.5 |
| 6,415,916 | B1 | 7/2002 | Rini | |
| 6,592,378 | B2 * | 7/2003 | Norberg | G09B 23/28 206/232 |
| 6,712,398 | B1 | 3/2004 | Fox et al. | |
| 6,749,229 | B2 | 6/2004 | Kennedy | |
| 7,316,310 | B2 * | 1/2008 | Saschin | B65D 75/38 132/333 |
| 2001/0002753 | A1 * | 6/2001 | Hollwarth-Oberholz | G09F 3/0289 283/81 |
| 2003/0121810 | A1 | 7/2003 | Roshdy | |
| 2003/0136698 | A1 * | 7/2003 | Klatt | A61J 1/035 206/499 |
| 2011/0192751 | A1 | 8/2011 | Doster | |
| 2014/0059906 | A1 | 3/2014 | Delise, Jr. | |
| 2014/0151250 | A1 * | 6/2014 | Nguyen | G09F 23/10 206/232 |
| 2015/0287343 | A1 | 10/2015 | Moore | |

FOREIGN PATENT DOCUMENTS

| | | | |
|---|---|---|---|
| EP | 1215127 | A1 | 6/2002 |
| EP | 1237137 | A3 | 12/2004 |
| GB | 2213428 | A | 8/1989 |
| GB | 2290752 | A | 1/1996 |
| GB | 2483680 | A | 3/2012 |
| GB | 2504467 | A | 2/2014 |
| WO | 200204313 | A2 | 1/2002 |
| WO | 2008142434 | A2 | 11/2008 |
| WO | 2009127736 | A | 10/2009 |
| WO | 2011/141870 | A1 | 11/2011 |
| WO | 2011141870 | A1 | 11/2011 |
| WO | 2014/013441 | A1 | 1/2014 |
| WO | 2014013441 | A1 | 1/2014 |

* cited by examiner

HEALTHCARE PRODUCT PACKAGE

CROSS-REFERENCE TO RELATED APPLICATIONS

This application is filed pursuant to 35 U.S.C. § 371 as a United States National Phase Application of International Application No. PCT/EP2017/052934 filed Feb. 9, 2017 which claims priority from U.S. 62/293,911 filed Feb. 11, 2016 and GB 1602470.5 filed Feb. 11, 2016.

FIELD OF THE INVENTION

The invention relates to inter alia a healthcare product package, an information unit for a healthcare product and a method for forming a healthcare product package.

BACKGROUND OF THE INVENTION

It is known to provide healthcare products with an information article which contains informational content on the healthcare product. The informational article is typically located in the container (e.g. carton or box) along with the healthcare product. Examples of such healthcare products are pharmaceutical products, for instance blister packs with tablets, pills or the like, and the associated information article is a patient information leaflet (PIL).

For some healthcare products, it may be necessary to locate more than one information article into the container.

Regardless, hitherto the information articles have been provided loose into the container. Problems can arise in locating (e.g. inserting) and removing the loose information article from the container. Moreover, manufacturing complexities can exist for locating the loose information article into the container.

As background art there may be mentioned GB2213428A, US5127676, GB2290752A, US2001/002753A, EP1215127A, EP1237137A, US6749229, U.S. Pat. No. 6,712,398, WO2008/142434A, GB2483680A, WO2014/013441A, US2014/0059906A, U.S. Pat. Nos. 3,076,541, 5,263,743, 5,458,374, 6,270,121, WO2002/04313A, GB2504467A and WO2011/141870A. Additional background art is the Piggyback™ leaflet system available from Essentra Packaging in which two or three folded leaflets are formed separately then glued together in back-to-back arrangement (http://healthcare.essentrapackaging.com/en/products/leaflets/piggyback).

As further background art there may be mentioned US2015/287343A, U.S. Pat. No. 6,415,916, US2003/121810A, EP0246840A, WO2009/127736A, and US2011/192751A.

An aim of the invention is to provide an improved way for locating an information article in a healthcare product package.

SUMMARY OF THE INVENTION

According to a first aspect of the invention there is provided a healthcare product package comprising:

(a) a container for containing a healthcare product, and (b) an information unit which is located inside the container, wherein the information unit comprises a carrier and at least one information article attached to the carrier.

According to a second aspect of the invention there is provided an information unit adapted for association with a healthcare product, the information unit comprising a carrier and, attached thereto, at least one information article containing information about the healthcare product. The information unit may be adapted for location inside a container for the healthcare product, e.g. a carton or box. Preferably, the at least one information article is for the patient (e.g. a Patient Information Leaflet (PIL)/Package Insert), or for a healthcare professional (e.g. a Doctor's information leaflet (DIL)), or is an instruction for use (IFU), each concerning the healthcare product.

According to a third aspect of the invention there is provided a method for forming a healthcare product package comprising taking an information unit according to the second aspect of the invention, taking a healthcare product with which the at least one information article of the information unit contains information on, and locating the information unit and the healthcare product in a container. The information unit and the healthcare product may be located in the container simultaneously or sequentially. The former will be the case where the information unit includes the healthcare product, as described hereinbelow. The latter may involve the information unit being located prior to or after location of the healthcare product in the container. The location of the information unit and/or healthcare product in the container may be by insertion into the container (e.g. through an opening in the container), or by forming the container about the information unit and/or healthcare product.

Preferably, the carrier is in the form of a substrate (i.e. is a carrier substrate), for example a base card or backing card, as in the illustrated embodiments herein.

Information Unit

The use of the information unit makes it easier for the manufacturer to locate (e.g. insert) the at least one information article in the container. For example, hitherto the information article(s) itself had to be manipulated into the container. This can be awkward, especially when there are plural information articles to go into the container and/or when the information article(s) is of paper or a paper-like material. In the invention, however, the information article(s) can be located in the container more easily and quickly through use of the carrier, especially when using automated manufacturing apparatus (e.g. feeders, chutes, etc.) to manipulate and manoeuvre the information unit through (e.g. gripping of) the carrier. Another advantage is a reduction in the manufacturing equipment needed, especially if the carrier carries a plurality of information articles. Instead of using one feeder per information article, as is current practice, only one feeder would be needed for feeding the information unit (including the information article(s) carried thereon) into the container.

If an information article(s) is located loose in the container, as in the state of the art, it can be difficult or troublesome for a user to remove the information article(s), particularly when the information article(s) gets jammed or trapped in the container. In preferred embodiments of the invention, the information unit (i.e. with its information article(s)) is removable from the container. This makes it easier to remove the information article(s) from the container through the user grasping (e.g. pulling on) the carrier. To this end, the carrier is preferably located in the container so as to lie adjacent to an opening of the container. For instance, in the embodiments in which the carrier is a carrier substrate (e.g. base card/backing card), an end of the carrier substrate is located adjacent the opening. This may be achieved by using the carrier substrate to 'stand' the information unit in the container.

In embodiments, the healthcare product package is configured and arranged such that (i) an edge of the carrier is located in proximity to a container opening and (ii) the carrier is unable to move in the container to place the carrier edge remote from the container opening. This may be achieved by appropriate selection of the dimensions of the carrier relative to the dimensions of the container to maintain the spatial relationship between the container and the information unit so that the carrier may always be located proximate the opening of the container for a user to grasp hold thereof for removing the information unit from the container. As an example, the carrier dimensions relative to those of the container are selected such that the carrier is unable to rotate in the container. In embodiments, the carrier and container may each have a major dimension and a minor dimension, wherein the major dimension of each is greater than the respective minor dimension and wherein the carrier major dimension is larger than the container minor dimension, but smaller than the container major dimension. This facilitates insertion of the carrier into the container, but prevents rotation of the carrier within the container, thus ensuring that the information unit remains in the orientation of insertion, i.e. as it was inserted in the container, or when the container was formed about it.

In embodiments, the carrier has a rectangular plan form (footprint), and the container has a rectangular plan form, and the length of the carrier is greater than the width of the container, and the length of the carrier is less than the length of the container. Preferably, the length of the carrier is at least 90% of that of the container. This means the edge of the carrier is always available near to the opening of the container, but there is enough free movement to allow automatic closing of the container.

In embodiments, the container and carrier have footprints of the same general shape, but the carrier footprint size is less than that of the container footprint. Preferably, the footprint sizes are within 90% of one another.

In embodiments of the invention, the relative dimensions of the carrier and the container are such that the carrier is able to pass through an opening of the container to a rest position in which a carrier edge is located inside the container, but proximate the container opening. As an example, the carrier may have first and second ends, one of which rests against the internal surface of the container in the rest position and the other of which is inside the container, but proximate the container opening.

To enable the at least one information article to be easily read after the information unit has been removed from the container, it is preferable that the at least one information article is separable from the carrier, for instance by being releasably attached to the carrier. In embodiments of the invention, the at least one information article is secured to the carrier by a temporary adhesive, for example a peelable glue. The temporary adhesive may be applied as one or more spots. The skilled reader will readily conceive of other ways to achieve the releasable attachment.

In embodiments, the information unit is the solitary information unit in the container.

In other embodiments, the information unit is a first information unit and at least one further information unit is located within the container. The further information unit may comprise the same information article(s) as the first information unit (e.g., useful if the container is to contain a plurality of the same healthcare product, as described hereinbelow) or carry at least one different information article (e.g. useful if the container is to contain different healthcare products therein as each healthcare product then has its own associated information unit; i.e. the information article(s) of one/each information unit contains information about a different one of the healthcare products than the information article(s) of another/each other information unit).

As the container may contain a plurality of information units, statements herein about an information unit are applicable to each information unit in the invention.

Preferably, the information unit is freely located in the container (i.e. not physically attached to the container), as in the illustrated embodiments. Preferably, the information unit is wholly enclosed within the container, as in the illustrated embodiments.

Typically, the information unit consists only of the carrier and the information articles as component parts.

Preferably, as in the illustrated embodiments, the information unit does not include means for enclosing, in whole or in part, the information articles, such as an oversheet or overlaminate.

The information unit may be as described in any of the embodiments described hereinafter with reference to the accompanying FIGURES of drawings.

Carrier

Preferably, the carrier is in the form of a sheet, more preferably a planar sheet, having opposing major (e.g. top and bottom) surfaces, and the at least one information article is mounted on and attached to one (e.g. the top) major surfaces. A sheet-form carrier minimises the amount of material used for the carrier, and also the container which would otherwise have to be larger, and hence costs. Preferably, the carrier is a sheet-form base card/backing card, as in the illustrated embodiments.

The carrier may be made from paper, card, plastic or a mixture (e.g. laminate) thereof. The carrier will typically be of a board material (for instance, paperboard, fibre-board or cardboard) and/or of a laminate (e.g. multi-ply) construction.

Preferably, the carrier has a square or rectangular shape (i.e. has superimposed top and bottom sides/faces which are both square or both rectangular (as in the illustrated embodiments of the invention hereinafter disclosed)). In embodiments, the carrier has a rectangular shape with an aspect ratio (length to width) of at least 1.5:1, preferably in the range of 1.5:1 to 3:1.

Preferably, as in the illustrated embodiments, the carrier is larger than credit-card size; for example, the carrier has a maximum dimension which is greater than 90 mm, and more preferably at least 100 mm.

In embodiments, the length of the carrier is in the range of 100-200 mm.

In embodiments, the width of the carrier is in the range of 50-80 mm.

In embodiments, such as the illustrated embodiments, the carrier is thin, for example has a thickness in the range of 0.1-2 mm.

Each of the illustrated embodiments may be made to satisfy the dimensional ranges mentioned hereinabove.

It will be appreciated that other shapes and dimensional ranges for the carrier, besides those stated above, may be used without departing from the scope of the invention.

Preferably, the carrier has an appropriate (e.g. stiff) construction, e.g. to enable it to be inserted into the container with the at least one information article (and the healthcare product(s) thereon, if provided thereon, as described infra), especially manipulation and insertion by automated production line machinery, such as leaflet feeders, pusher arms, chutes, cams, pick-and-place robotic arms, etc. Conveniently, the carrier is made from a material having a stiffness which is similar to that provided by paperboard.

In embodiments, such as those shown in FIGS. 1 to 9 hereinafter to be described, the carrier is a single, rigid piece of sheet material.

In embodiments, such as those shown in FIGS. 1 to 9 hereinafter to be described, the carrier is provided with no special means that would enable the carrier to change the size of its footprint, e.g. to be (un)folded (i.e. no folding lines), excluding any provided for an optional peripheral wing or wings.

Preferably, as in the illustrated embodiments, the carrier is not an adhesive label nor a container (e.g. blister pack). Preferably, as in the illustrated embodiments, the carrier does not have any means for attaching itself to the container (only for securing the information article(s) and, optionally, also healthcare product(s) thereto). Preferably, as in the illustrated embodiments, the side/face of the carrier opposite to that which carries the information article(s) is not provided with adhesive or other attachment means for attaching the carrier to another object (e.g. the container).

In accordance with the present invention (i.e. in all of its different aspects), the carrier may be in a collapsed state and be movable to an extended state (a so-called 'extendible carrier'). The collapsed state is the (compact) form that the extendible carrier is in when it is in (and being located in) the container of the related healthcare product. After the extendible carrier is removed from the container it is able to be extended to its extended state. The extendible carrier may be extended with all or some of the one or more information articles either (i) still being attached thereto, or (ii) having been detached therefrom.

Preferably, the extendible carrier is comprised of at least two panels of which at least one is movable relative to the other to move between the collapsed and extended states. Conveniently, the carrier may consist or substantially consist of the panels. Conveniently, the carrier panels may be of the same, or substantially the same, shape and size. Preferably, in the collapsed state of the carrier the carrier panels locate in an overlying (stack) arrangement, more preferably an overlying arrangement in which the panels are co-extensive or substantially co-extensive.

Preferably, the collapsed state of the carrier is an overlying arrangement of (optionally all of) the carrier panels.

Typically, the extendible carrier will carry the at least one information article on an outer surface thereof when in the collapsed state. Alternatively, the at least one information article may be carried inside the extendible carrier when in its collapsed state, e.g. sandwiched between opposing facing surfaces of the carrier panels in the collapsed state.

Preferably, the footprint of the carrier in its collapsed state is the same or substantially the same as the footprint of the largest panel of the carrier.

Preferably, the carrier is able to extend to an extended state which is a sheet form, more preferably a planar sheet form (i.e. a generally two dimensional (i.e. flat) form; small thickness).

Preferably, the collapsed and extended states are respectively folded and unfolded states of the carrier. As an example, the carrier may have one or more fold lines to define a plurality of carrier panels which can be folded about the fold lines between it and an adjacent carrier panel. Conveniently, if there are a plurality of fold lines, all fold lines are parallel or substantially parallel to one another. Alternatively, there may be fold lines arranged perpendicularly to each other, optionally intersecting each other. In simple forms, the fold lines may be arranged as follows:

- a single fold line to divide (e.g. bisect) the carrier into two carrier panels;
- plural fold lines, all parallel or substantially parallel to one another, so that the carrier is divided into a row of at least three consecutive carrier panels (i.e. X+1 panels, where X is the number of fold lines) thereby creating a carrier of concertina form; or
- a pair of intersecting fold lines arranged perpendicularly or substantially perpendicularly to each other so as to divide the carrier into four carrier panels (quarters).

Preferably, the fold lines are arranged so that the carrier panels are foldable to overlie each other in the folded state. More preferably, in the folded state the carrier panels are stacked to be co-extensive or substantially co-extensive with one another.

Preferably, the fold lines are arranged so that all of carrier panels are of the same shape and size. This is particularly useful where the co-extensive stack arrangement mentioned in the paragraph above is required.

Preferably, the shape and size of the carrier in its collapsed (e.g. folded) state corresponds to or substantially corresponds to the shape and size of one (and optionally all) of the carrier panels.

An advantage of the extendible carrier is that its outer surface area is increased by moving from the collapsed state to the extended state. Consider, some of the outer surface area of the carrier in its extended state forms some or all of the internal surface area of the carrier in its collapsed state.

Accordingly, the extendible carrier is able to present a greater outer surface area when in its extended state than a carrier (e.g. a non-extendible carrier, such as those in FIGS. 1 to 9 hereinafter to be described) which presents a maximum outer surface area corresponding to the outer surface area of the extendible carrier when in its collapsed state. This means the extendible carrier can present more information on it than if it only had the outer surface area of its collapsed state (i.e. the size for its function to locate the at least one information article in the container). So, the extendible carrier provides an opportunity to have a carrier which not only fulfils its function to carry at least one information article and locate same in a container, but which can also function to carry extra information on it (e.g. concerning the related healthcare product). With this in mind, in a preferred embodiment the extendible carrier is provided with information on one or more surface areas of the carrier which are internal surface areas in the collapsed state, but outer surface areas in the extended state. This may or may not be additional to information provided on the outer surface area(s) of the carrier in both its collapsed and extended states. Where the carrier is comprised or consists of carrier panels, it is preferable that information is presented by more than one such carrier panel.

Preferably, the extendible carrier is a quickstart guide. A quickstart guide is a short, simple introductory guide created to get users quickly accustomed to the basic operations of something (which may comprise set-up guidance).

In the context of the present invention, a quickstart guide will typically concern the healthcare product or pharmaceutical product, and most typically the delivery device of such a product. In the latter case, the quickstart guide may be a guide to the basic operations of the delivery device.

Typically, the quickstart guide provides its guidance at least in part through use of pictorial representations, for instance ideograms.

Typically, the guidance provided by the quickstart guide will be information printed on the carrier.

Typically, the extendible carrier is made from a sheet-like structure (i.e. effectively a two dimensional (flat) structure), for example made of a board material, particularly for the foldable carrier in which the fold lines are formed in the sheet-like structure (so-called 'blank') by scoring, creasing or other means known in the packaging art.

In embodiments, the size of the carrier in its extended state prevents it from being able to be located in the container (or moved from the collapsed state to the extended state when located in the container). For example, the carrier in its extended state is unable to pass through an opening of the container for location in the container.

Preferably, the carrier has a footprint of a rectangular or square shape.

In the embodiments where the carrier is extendible, this carrier preferably has a footprint which is rectangular or square in either its collapsed state or extendible state, more preferably in both states.

In yet more preferred embodiments, the footprint shape of the carrier in its collapsed and extended states is the same.

Preferably, the extendible carrier is comprised of panels of a rectangular or square shape or a mixture of such shapes. Ideally, the panels of the carrier are of the same shape, and yet more preferably of the same size. Even more preferably, all panels are as stated in the preceding two sentences.

In embodiments, the extendible carrier in its collapsed state carries one or more accessories therewithin. The accessory will typically be related to the healthcare product; for instance one or more swabs for wiping a planned injection site on the skin of a living human or animal body where the healthcare product comprises a syringe or an (auto)injector.

The collapsed state may be maintained by a releasable attachment, for instance a temporary adhesive. Other forms of releasable attachment can be conceived of, including an integrally formed fastening feature of the carrier (e.g. an integrally formed fastening feature of a carrier blank).

The carrier may be as described in any of the embodiments of the invention described hereinafter with reference to the accompanying FIGURES of drawings.

Information Article(s)/Healthcare Product(s)

Typically, the information article(s) is made from paper or a paper-like material, as in the illustrated embodiments.

Typically, the information article or at least one (some or all) of the information articles provides information about the healthcare product. In embodiments, the container is for containing a solitary healthcare product. In other embodiments, the container is for containing a plurality of the healthcare products (i.e. each is the same). In yet other embodiments, the container is for containing another healthcare product which is different (e.g. a different type, different strength, etc.) and the information unit further comprises an information article for the different healthcare product.

The information on the healthcare product(s) may be user instructions, safety information or product specification/characteristics, etc.

The healthcare product(s) may be composed of at least first and second parts (e.g. a dispenser as the first part and one or more refills therefor as the second part) and the information unit comprises an information article for each said part.

Typically, as in the illustrated embodiments, the information is presented on the at least one information article in a form that is comprehensible to a human, preferably a viewable (e.g. readable) content, for instance in the form of text, figures, images and suchlike or mixtures thereof.

Any information article(s) carried on the carrier may be in a folded-up state, as in the illustrated embodiments of the invention disclosed hereinafter; methods for folding are known in the packaging art. If there a multiple information articles on the carrier, some or all of them may be folded-up.

Typically, the information article(s) for use in the invention is a printed information article, more typically a printed paper article.

Non-limiting examples of an information article for use in the invention are leaflets, labels, booklets, vouchers, coupons and the like. These may be printed and/or made of paper or a paper-like material.

Non-limiting examples of leaflets for use in the invention are plain leaflets (e.g. glued together), Glueserts, tagserts, wrapserts, etc., as is known in the packaging art.

In embodiments, the/each healthcare product or one of the healthcare products to be contained in the container is a pharmaceutical product and the information unit contains one or more information articles containing information about the pharmaceutical product and/or its characteristics. This information will typically be about the medicament in the pharmaceutical product, e.g. composition (e.g. the active substance(s) and (if any) other formulation components (e.g. excipients)), side effects, contraindications, dosage, etc. This information article may be a leaflet, more particularly a folded leaflet. An example of such an information article is called a 'patient information leaflet' (PIL) in Europe and a 'package insert' (formerly called 'prescribing information') in the United States of America (USA). Another example of such an information article is one for a healthcare professional (e.g. physician or clinician), for instance a Doctor's Information Leaflet (DIL)). In embodiments, the information unit comprises a PIL and a DIL.

The term "pharmaceutical product" herein means drug products, biopharmaceutical products, vaccine products or any other product containing one or more substances with properties for treating, preventing, palliating or diagnosing disease in human beings (including symptomatic treatment). The term "medicament" herein is to be understood having regard to this meaning of pharmaceutical product.

In embodiments, the pharmaceutical product comprises a delivery device for the medicament and the information unit comprises at least one information article containing information about the delivery device, for instance user/operation instructions, information about the device and its characteristics, etc. (known as "Instructions for Use"). Non-limiting examples of such a delivery device are a syringe, (auto) injector, inhaler, sprayer, patch, etc. The delivery device may be pre-loaded with a medicament dosage form (e.g. vial, ampoule, cartridge, capsule, tablet(s), inhalation powder, aerosol, etc.) and/or be for (re)use with separate medicament dosage forms which need to be loaded into the delivery device. Typically, such information article(s) for the delivery device will be in the form of a (folded) leaflet.

In preferred embodiments of the invention, such as those hereinafter described with reference to the drawings, the container is to contain a pharmaceutical product (or plural pharmaceutical products of the same type) and the package includes at least two information articles (e.g. two folded leaflets) containing information about the pharmaceutical product, for example information about the pharmaceutical product chosen from the group consisting of information about (i) the medicament, (ii) the delivery device for the medicament, and (iii) a refill for the delivery device. The at least two information articles may comprise at least one information article with information about the medicament (e.g. a PIL and/or a DIL) and an information article about the delivery device (e.g. Instructions for Use). The at least two information articles are preferable arranged as a stack on the carrier, as described hereinbelow.

In embodiments, the information unit has as information articles: a PIL, a DIL and Instructions for Use. Each may be a folded leaflet and/or arranged as a stack (infra).

The information article(s) may be as described in any of the embodiments described hereinafter with reference to the accompanying FIGURES of drawings.

Container

In embodiments, the container is closed with the information unit located therein.

The container is adapted to be opened to enable access to the contents in its inner space. Preferably, the container has a closable opening through which the information unit is adapted to be introduced (e.g. inserted) and/or removed from the container. Preferably, the opening, when closed, can be opened to enable the information unit to be removed from the container. The opening may be closed by at least one closure of the container. Preferably, the opening is common to the healthcare product, enabling its introduction into and/or removal from the container.

The opening may be re-opened after it is closed, e.g. to enable removal of the information unit and/or healthcare product. The opening may or may not be able to be re-closed, depending on the nature of the closure. If the opening is closed by a single-use closure, for example of the "tear-and-forget" type, re-closure of the opening is not possible.

The container may be a box or carton, for instance erected from a preform, such as a blank, for example by folding (e.g. a blank with fold- or score-lines to enable it to be erected into the container). Typically, the blank for the box or carton has one or more panels which define the at least one closure.

Alternatively, the container may be a book structure or a wallet structure. An example of a book or wallet structure is a structure having two parts joined at a hinge (or spine) so that the parts can be hinged between a closed position, in which the parts are overlying to define an inner space therebetween which contains the information article and for containing the healthcare product, and an open position, in which the parts are separated to enable removal of the information unit/healthcare product.

Typically, the container (regardless of type) will be of generally polygonal (e.g. rectangular or square) form. Moreover, the container (regardless of type) will typically be made of a board material (for example paperboard, fibreboard or cardboard) and/or formed from a preform, for example a blank (for example a one-piece blank) provided with appropriate fold- or score-lines to enable the blank to be erected into the container. Alternatively, the container may be made with a polymeric material or mixture of materials including a polymeric material.

Where the container is a box, for instance a carton, the container will comprise a number of walls (e.g. presented by panels) circumscribing the inner space of the box/carton, at least one opening to the inner space and at least one closure for each opening. The at least one closure may be in the form of one or more closure flaps, for instance one or more closure flaps which close-off and tuck into the opening, as known in the packaging art.

Typically, especially where the box/carton is of polygonal form, the box/carton will have a top panel, bottom panel and a plurality of side panels extending between the top and bottom panels (the number depending on the shape of the box/carton). One or more of these panels forms a closure to an opening to the inner volume of the container. Such panel(s) may be in the form of one or more closure flaps. An example of a carton of this type is described hereinbelow with reference to FIG. 10.

Preferably, the information unit and/or healthcare product would be introduced into the container by insertion thereinto through an opening of the container. However, other means of locating the information unit and/or healthcare product in the container may be envisaged within the scope of the invention; for example, forming the container around the information unit and/or healthcare product, particularly where the container is formed from a perform, e.g. a blank.

The container may be as described in any of the embodiments of the invention described hereinafter with reference to the accompanying FIGURES of drawings.

Healthcare Product

As indicated hereinabove, the healthcare product (to be) contained in the container may be a pharmaceutical product which optionally includes a delivery device for the medicament of the pharmaceutical product.

In embodiments of the invention, the container contains the healthcare product. The healthcare product may be (i) the solitary healthcare product in the container, or (ii) one of a plurality of the healthcare products (i.e. each is the same), or (iii) a first healthcare product with the container also containing a second, different healthcare product (e.g. of a different strength or a different type). In the latter case, the information unit preferably comprises an information article for each respective different healthcare product or the information unit has an information article about the first healthcare product and an additional information unit is located within the container and comprises an information article about the second healthcare product.

In embodiments, the healthcare product is mounted to the carrier. In this case, the healthcare product is located in the container by the information unit (i.e. because the healthcare product is mounted on the carrier, along with the information article(s), prior to the information unit being located in the container). The mounting may be so that the healthcare product is not attached to the carrier; i.e. it is freely movable/removable. Alternatively, the healthcare product may be fixed against movement (other than play) on the carrier; i.e. the healthcare product is attached (typically releasably) to the carrier. In embodiments, there are plural healthcare products mounted to the carrier in the container.

Typically, the or each healthcare product is mounted to the same side of the carrier as the at least one information article.

As the container may contain a plurality of healthcare products, statements herein about a healthcare product are applicable to each healthcare product.

In embodiments, the pharmaceutical product comprises an antigen binding protein that specifically binds to B Lymphocyte Stimulator (BlyS). The antigen binding protein may be an antibody or fragment thereof. The antigen binding protein may be a monoclonal antibody such as a chimeric, human or humanized antibody. The antigen binding protein may be comprised in a formulation for parenteral administration, examples being intravenous and sub-cutaneous administration. In embodiments, the BlyS binding antibody is belimumab.

In embodiments, the pharmaceutical product comprises a syringe or (auto)injector which is prefilled with a belimumab formulation or other formulation containing an antigen binding protein that specifically binds to BlyS.

The pharmaceutical product referred to in the preceding two paragraphs may be for treating a B-cell regulated autoimmune disorder, for example lupus, in particular systemic lupus erythematosus (SLE).

Plural Information Articles and Stacking

In embodiments where there are plural information articles in the information unit, the information articles are of the same type or are a mixture of different types. Typically, when there are plural information articles these are attached (e.g. releasably) to a common side of the carrier, either in a simple side-by-side arrangement on the common carrier side or in a stack arrangement, non-limiting examples of which are found in the illustrated embodiments of the invention hereinafter to follow.

A "stack" is created by building-up information articles (e.g. folded leaflets) on top of each other on the carrier thereby creating two or more levels of information articles. As an example, the stack has at least (i) a bottommost information article which is attached (e.g. releasably) to the common (top) side of the carrier, and (ii) a topmost information article which is attached (e.g. releasably) to the top side of an information article in the stack immediately behind it. In its simplest form, the stack consists only of these two information articles so that the topmost information article is attached to the bottommost information article. In other simple forms, the stack includes at least one intermediate information article sandwiched between the topmost and bottommost information articles. Each such intermediate information article is attached (e.g. releasably) to the information article in the stack immediately behind it (i.e. the bottommost information article or another intermediate information article, depending on if there is more than one intermediate information article) and supports the information article in the stack atop it (i.e. the topmost information article or another intermediate information article; again, depending on if there is more than one intermediate information article). By way of example, for the stack the information articles may be arranged relative to each other as in the Piggyback™ leaflet available from Essentra Packaging; here, two or three folded leaflets are formed separately then glued together in back-to-back arrangement (http://healthcare.essentrapackaging.com/en/products/leaflets/piggyback).

More complex stacks are also envisioned. For example, a stack in which there is more than one information article at the same level of the stack, whether that be at the bottommost level, the topmost level or an intermediate level. Moreover, a stack may include one or more branches in it. Such branches may or may not recombine at a level of the stack (i.e. an information article straddles or bridges across to some or all of the branches.

By "stacking" or "stacked" herein means arranging information articles on the carrier to form a stack or series of stacks on the carrier.

In embodiments, there is either a single stack on the carrier or there are plural independent stacks (i.e. none of the information articles in the respective stacks are shared with another stack).

The attachment between the information article(s) and the carrier and/or between respective information articles is preferably releasable so that the information articles can be separated from the carrier and/or each other. By way of example only, the releasable attachment may be through use of a temporary adhesive, for instance in the form of a peelable glue/adhesive. The temporary adhesive can be applied as one or more spots between the information article and the other element (carrier and/or other information article) it is to be releasably attached to.

The information articles may be arranged on the carrier as described in any of the embodiments described hereinafter with reference to the accompanying FIGURES of drawings.

Miscellaneous

Preferably, neither the carrier nor the information unit is attached to the container. No means for any such attachment are provided to the carrier, information unit or container. Thus, no special measures are needed to remove the information unit from the container, such as detaching or the like.

Preferably, the carrier does not comprise or form a blister structure (e.g. blister pack or blister tray) or any part thereof.

In embodiments, the healthcare product does not comprise an artificial tooth or component thereof.

Preferably, the information unit does not comprise any part of the container, e.g. any integrally formed part of the container, such as a panel or flap etc. thereof. In other words, the information unit and the container are formed wholly separately.

Further non-limiting embodiments of the various aspect of the invention are described hereinafter with reference to the accompanying FIGURES of drawings.

Each embodiment of the invention described herein may include one or more of the features of one or more of the other embodiments herein described.

DETAILED DESCRIPTION OF THE DRAWINGS

Figure 1:
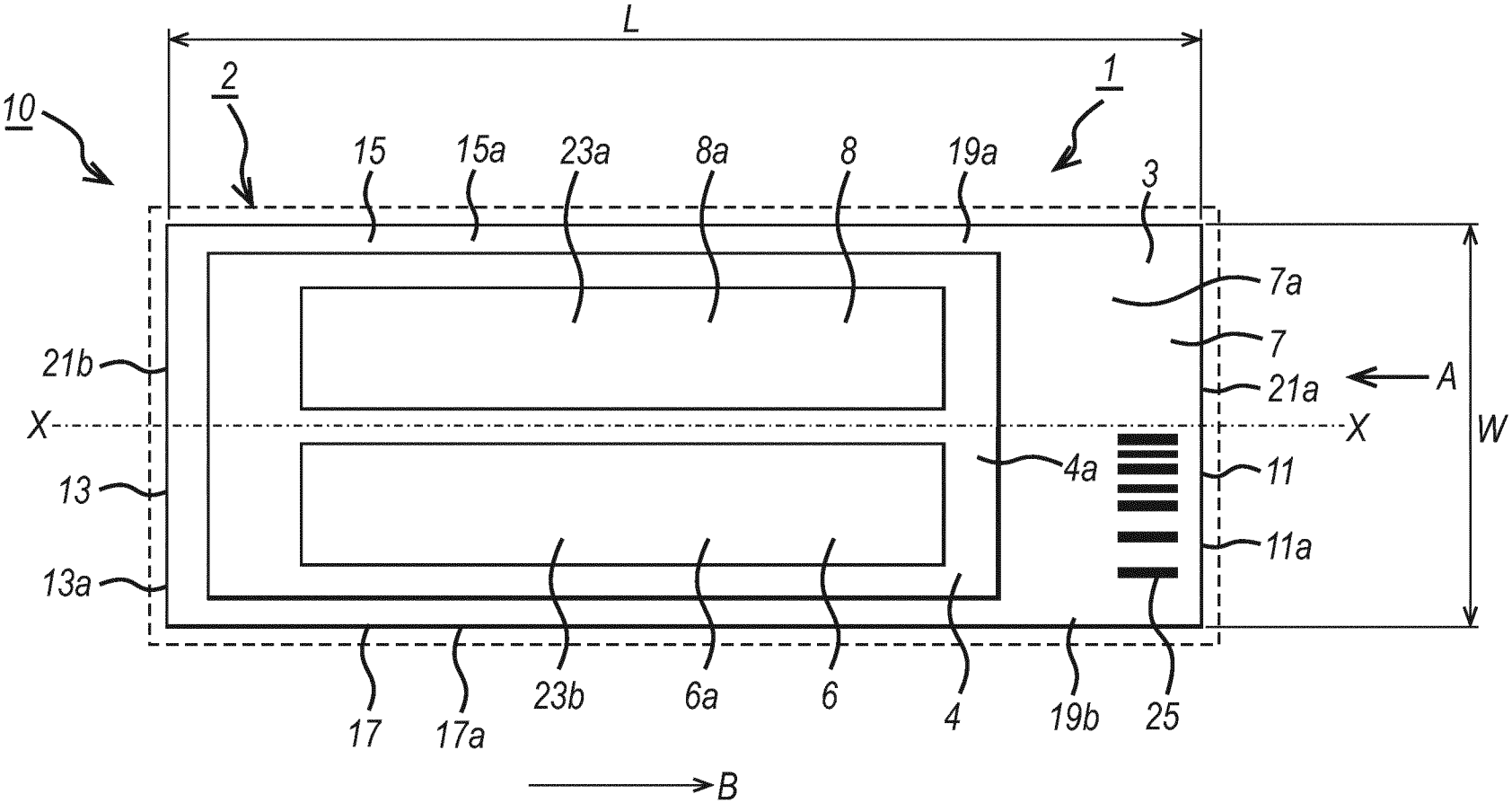
FIG. 1 is a plan (or top) view of a first information unit/healthcare product package in accordance with the invention.

In the following there is described a number of illustrated embodiments of the invention which correspond closely to each other. For convenience, only the first embodiment shall be described in great detail. The other embodiments are described mainly in terms of their different features and properties, with their other details being understood as being as described for the first embodiment. For further convenience, like features in the different embodiments are identified by like reference numerals in the FIGURES of drawings (e.g. the reference numbers 3, 103, 203, etc., and 19*a*, 119*a*, 219*a*, etc. and so forth are common to like features across the FIGURES).

In the following description of the illustrated embodiments, the healthcare product may be of any of the types previously mentioned in this specification; for example, a pre-filled autoinjector.

In FIGS. 1, 2, and 2A-C there is shown a first information unit 1 in accordance with the invention. The first information unit 1 is adapted in use to be located in, and form an insert to, a container (schematically indicated at 2 in chain-line in FIG. 1 at 2) to form a first healthcare product package 10 in accordance with the invention, for instance as is described hereinafter with reference to FIG. 10.

Figure 2:
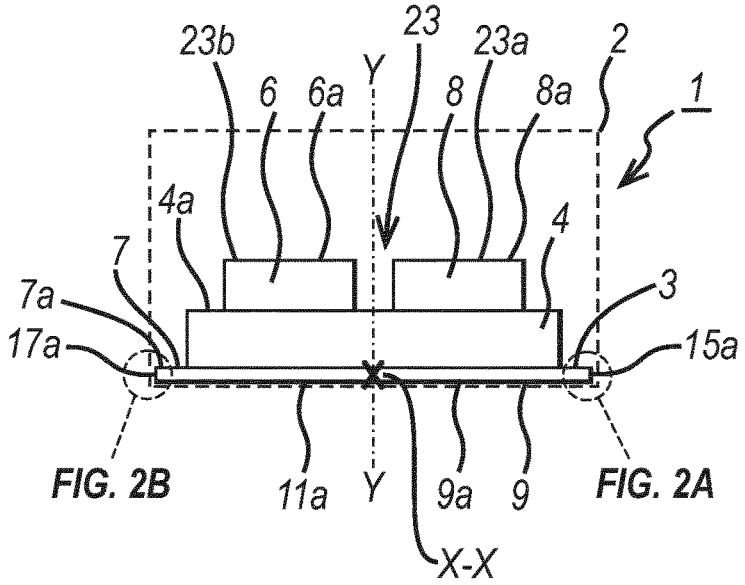
FIG. 2 is a front view in the direction of arrow A in FIG. 1.
Figure 2A:
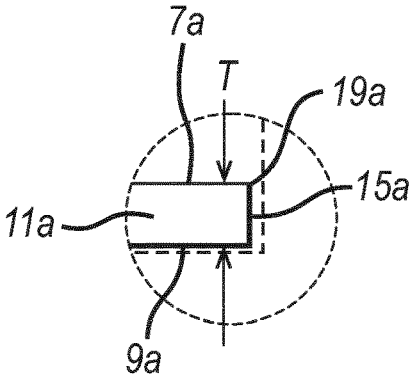
FIGS. 2A and 2B are enlarged scrap views from FIG. 2.
Figure 2B:
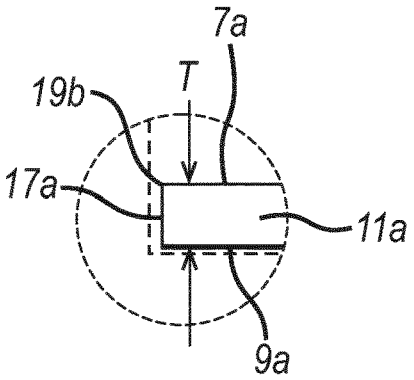

The container 2 may be of any form elsewhere described in the present specification, e.g. a carton or box erected from a blank. FIGS. 1 and 2 show the first information unit 1 inside the closed container 2.

The first information unit 1 comprises a carrier 3 and plural information articles 4, 6, 8 attached to the carrier 3. In this embodiment, the information articles are in the form of folded leaflets. The folded leaflets 4, 6, 8 each contain information relating to a healthcare product or plurality of healthcare products (not shown) also to be included in the container 2. The informational content of the folded leaflets may as described elsewhere in this specification. By way of example, the healthcare product package is to contain one or more of the same healthcare product and one of the folded leaflets is a Patient Information Leaflet (PIL) (known as a Package Insert in the United States of America), another leaflet is for a healthcare professional (e.g. a Doctor's information leaflet (DIL)) and the third leaflet is an instruction for use (IFU) leaflet, each concerning that healthcare product (e.g. an autoinjector, either pre-filled with a drug formulation or coming with one or more drug-filled containers to mount in the autoinjector (e.g. vials or syringes)).

Figure 2C:
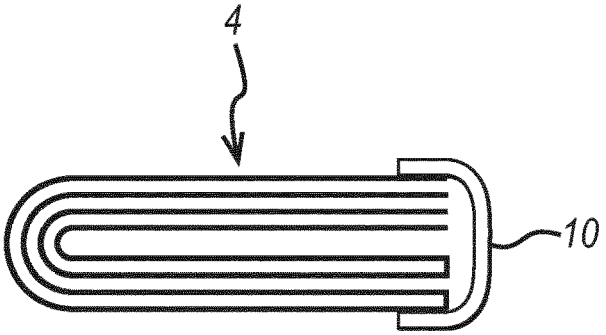
FIG. 2C is a front view of one of the information articles in the direction of arrow A in FIG. 1.

Each folded leaflet 4, 6, 8 is typically formed from a planar sheet of paper or paper-like material using methods and apparatus known in the art. For illustrative purposes, FIG. 2C is a front view of the folded leaflet 4. Typically, each folded leaflet 4, 6, 8 is provided with a fixing (for example a tie, such as shown at 10 in FIG. 2C), to hold it in its folded state, including when mounted on the carrier 3. The fixings can be undone by a user when appropriate so that the respective leaflets 4, 6, 8 can be unfolded and viewed (e.g. read).

The carrier 3 is a base card/backing card in the form of a planar sheet. In this embodiment, the carrier 3 is of rectangular shape. The carrier has a longitudinal axis X-X along a centre-line of the carrier 3, a top 7, a bottom 9, a front end 11, a rear end 13 and a pair of sides 15, 17. The carrier 1 has a width W, a length L and a thickness T (see FIGS. 2A and 2B).

The top 7 of the carrier 3 is presented by a major face 7*a* and the bottom 9 of the carrier 3 is presented by another major face 9*a*. The front end 11, rear end 13 and sides 15, 17 of the carrier 3 are presented by four minor sidewalls 11*a*, 13*a*, 15*a*, 17*a*, respectively. Each of the major faces 7*a*, 9*a* and the minor sidewalls 11*a*, 13*a*, 15*a*, 17*a* are planar.

The major faces 7*a*, 9*a* each have a pair of spaced-apart, outer (longitudinal) side edges 19*a*, 19*b*, which are straight and parallel to one another, and front and rear outer (lateral) edges 21*a*, 21*b* which are spaced-apart, straight and parallel to one another. The outer lateral edges 21*a*, 21*b* connect to the outer side edges 19*a*, 19*b* at the respective front 11 and rear ends 13. The sidewalls 11*a*, 13*a*, 15*a*, 17*a* extend respectively from the outer edges 21*a*, 21*b*, 19*a*, 19*b*, of the major top face 7*a* to the corresponding outer edges (not labelled) of the major bottom face 9*a*.

The folded leaflets 4, 6, 8 are attached to a major face, in this instance the top face 7*a*, of the carrier 3. Moreover, the folded leaflets 4, 6, 8 are arranged into a stack 23, having two levels, on the carrier top face 7*a*, with the bottom face of the folded leaflet 4 mounted to the carrier top face 7*a* (the first level) and the bottom faces of the second and third folded leaflets 6, 8 mounted to the top face 4*a* of the first folded leaflet 4 in a side-by-side layout (the second level). The stack 23 can be considered as branched into two branches 23*a*, 23*b*, defined by the second and third folded leaflets 6, 8 respectively.

As shown in FIGS. 1 and 2, the footprint of the (bottommost) folded leaflet 4 (and the stack 23 as a whole) is wholly inside the land area of the top face 7*a* of the carrier 3; however, the outer longitudinal side edges 19, 19*b* of the top face 7*a* of the carrier 3 are in close proximity to the outer longitudinal side edges (not labelled)) of the bottommost folded leaflet 4 in the stack 23 so as to minimise the amount of carrier material used. In other words, the side margins of the carrier 3 to either (longitudinal) side of the stack 23 are minimised.

As further shown in FIGS. 1 and 2, the arrangement of the folded leaflets 4, 6, 8 on the carrier 3 in this embodiment is symmetrical about a plane of symmetry Y-Y which incorporates (is coincident with) the longitudinal axis X-X and is oriented perpendicularly to the front face 7*a* of the carrier 3.

The mounting of the bottommost folded leaflet 4 to the carrier 3 and the topmost folded leaflets 6, 8 to the bottommost folded leaflet 4 is a releasable attachment, in this instance through use of a temporary adhesive, for example peelable glue, or other means apparent to the skilled person in the art. By way of example, one or more spots of a temporary adhesive (e.g. peelable glue) may be applied to the bottom face of each of the information articles 4, 6, 8 and the information articles 4, 6, 8 then mounted to each other and the carrier 3, as shown in FIGS. 1 and 2, so that the spots join the top faces 4*a*, 7*a* of the bottommost information article and carrier 3 to the bottom faces of the respective information article(s) overlying them. Alternatively, the spots can be applied to the top face 7*a* of the carrier 3 and to the top faces of the information articles other than the topmost one. Otherwise, a mixture of these two methods could be used. However, the first method mentioned would be the most simple and practical.

In this way, the folded leaflets 4, 6, 8 are able to be separated from each other and from the carrier 3 and unfolded (after removal of any fixings, such as ties 10) so that the informational content thereof can be viewed, typically after removal of the information unit 1 from the container 2 it has been located in.

On the major top face 7*a* of the carrier 3, in the corner between the front outer edge 11*a* and the outer side edge 19*b*, there is provided a machine-readable unique identifier or code 25, in this case a machine readable 2D code, more specifically a bar-code, for example a Pharmacode (also known as a Pharmaceutical Binary Code). Machine-readable unique identifiers or codes of other types (e.g. optical marks) could also be used, as will be appreciated by the skilled practitioner in the art.

The carrier 3 is made from a board material, typically paperboard, so as to have the requisite degree of stiffness to run on machines typically used in packaging lines. As an example, the board material may be made of paperboard of GC1 or GC2 grade (DIN Standard 19303). Where the carrier 3 is coated, such as in the case of GC2 grade paperboard, the coating is preferably on the bottom face 9*a*.

In a modification to the first information unit 1, not shown, another folded leaflet is included in the stack 23 to form a third level thereof. Depending on the size (footprint) of the additional folded leaflet, it either overlies and mounts to the front face 6*a*, 8*a* of just one of the folded leaflets 6,8 or it overlies (bridges) and mounts to both of those front faces 6*a*, 8*a* (for example, such as the folded leaflet 208 in the third information unit 201 described hereinafter with reference to FIGS. 5 and 6).

In an alternative modification to the first information unit 1, not shown, the stack 23 includes one or more further folded leaflets which are mounted to one of the branches 23*a*, 23*b* to build up that branch. The stack could also include one or more further folded leaflets which are mounted to the other branch 23*a*, 23*b* so that both branches 23*a*, 23*b* are built up.

Of course, the first information unit 1 could comprise a combination of the above two modifications; e.g. one or more additional folded leaflets on the branches 23*a*, 23*b* and one or more folded leaflets which bridge the branches 23*a*, 23*b*.

As shown, the information unit 1 is fully enclosed within the container 2 and is freely located therein (i.e. not attached to the container 2).

Figure 3:
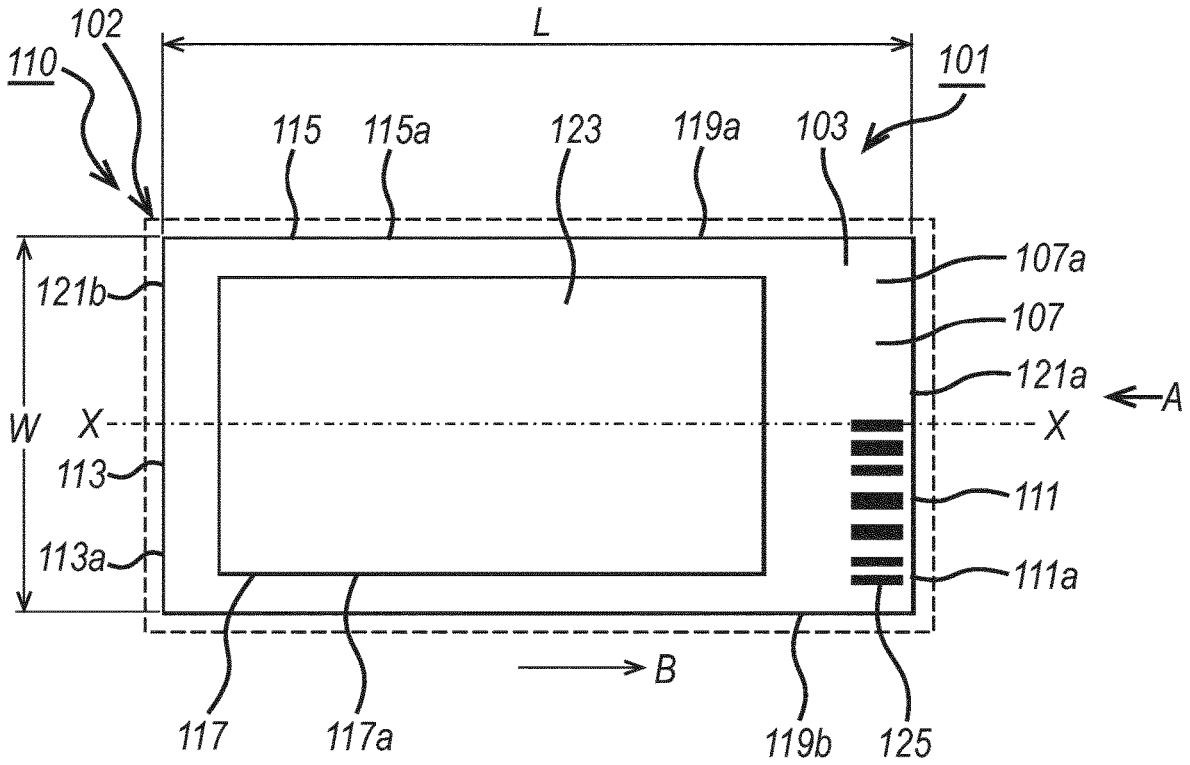
FIG. 3 is a plan view of a second information unit/healthcare product package in accordance with the invention.
Figure 4:
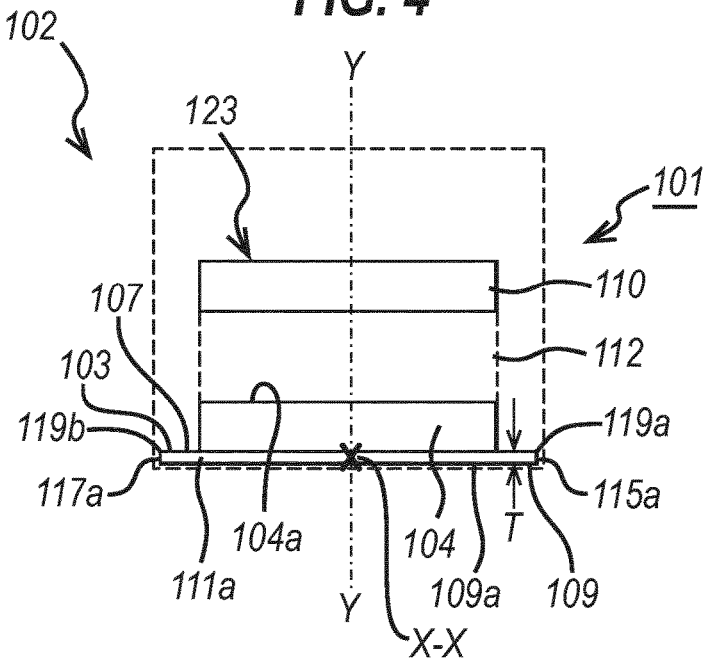
FIG. 4 is a front view in the direction of arrow A in FIG. 3.

In FIGS. 3 and 4 there is shown a second information unit 101 in accordance with the invention. The second information unit 101 is adapted in use to be located in, and form an insert to, a container (schematically indicated at 102 in chain-line in FIG. 3) to form a second healthcare product package 110 in accordance with the invention, for instance as described hereinafter with reference to FIG. 10.

The rectangular carrier 103 has a different, in this instance smaller, aspect ratio (L:W) than in the first information unit 1.

Moreover, the stack 123 of information articles (folded leaflets as before) is not branched, as in the first information unit 1, but made up of superimposed folded leaflets in the stack 123, one on top of the other (i.e. in a back-to-back or piggyback arrangement).

In more detail, the stack 123 has a bottommost folded leaflet 104 releasably mounted (e.g. with temporary adhesive) to the top face 107*a* of the carrier 103 (the first level) and a topmost folded leaflet 110 located above the bottommost folded leaflet 104 (the Nth level where N 2). As indicated by reference numeral 112 in FIG. 4, the stack 123 may optionally contain one or more intermediate folded leaflets in-between the bottommost and topmost folded leaflets 104, 110. If there are no intermediate folded leaflets 112, then the bottommost and topmost folded leaflets 104, 110 will be releasably attached directly to one another, e.g. with temporary adhesive. If, however, the stack 123 further includes at least one intermediate folded leaflet 112, then the bottom face of each such intermediate folded leaflet 112 will be mounted (e.g. with temporary adhesive) to the top face of the folded leaflet underneath it—e.g. the bottommost folded leaflet 104 or another intermediate folded leaflet 112, respectively, depending on if there is only one intermediate folded leaflet 112 or plural intermediate folded leaflets 112—and the bottom face of the topmost folded leaflet 110 will be mounted on the top face of an intermediate folded leaflet 112, which will be the topmost intermediate folded leaflet 112 where more than one is present in the stack 123.

The application of temporary adhesive, such as a peelable glue, may be by spotting, as previously described herein.

Figure 5:
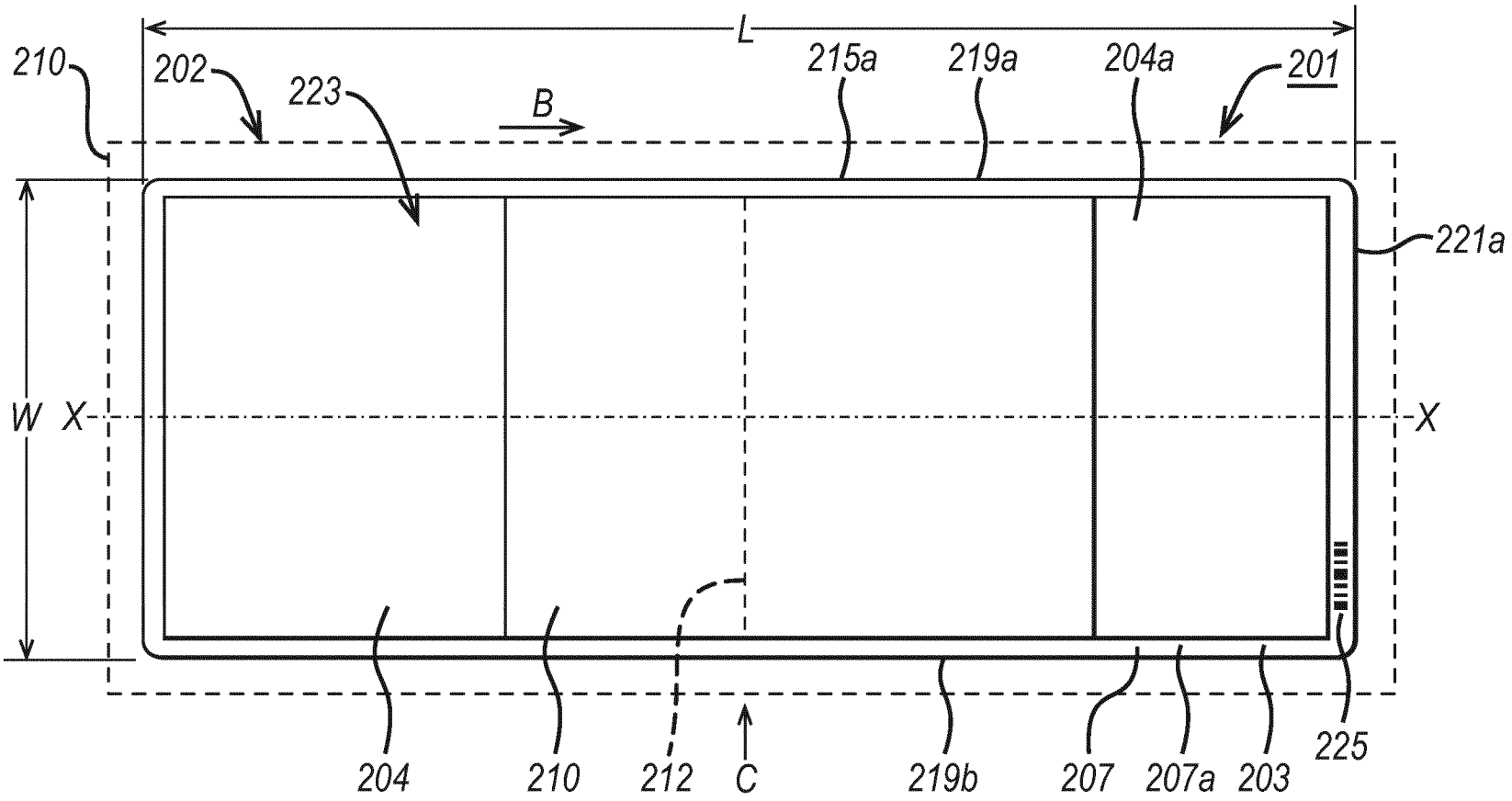
FIG. 5 is a plan view of a third information unit/healthcare product package in accordance with the invention.
Figure 6:
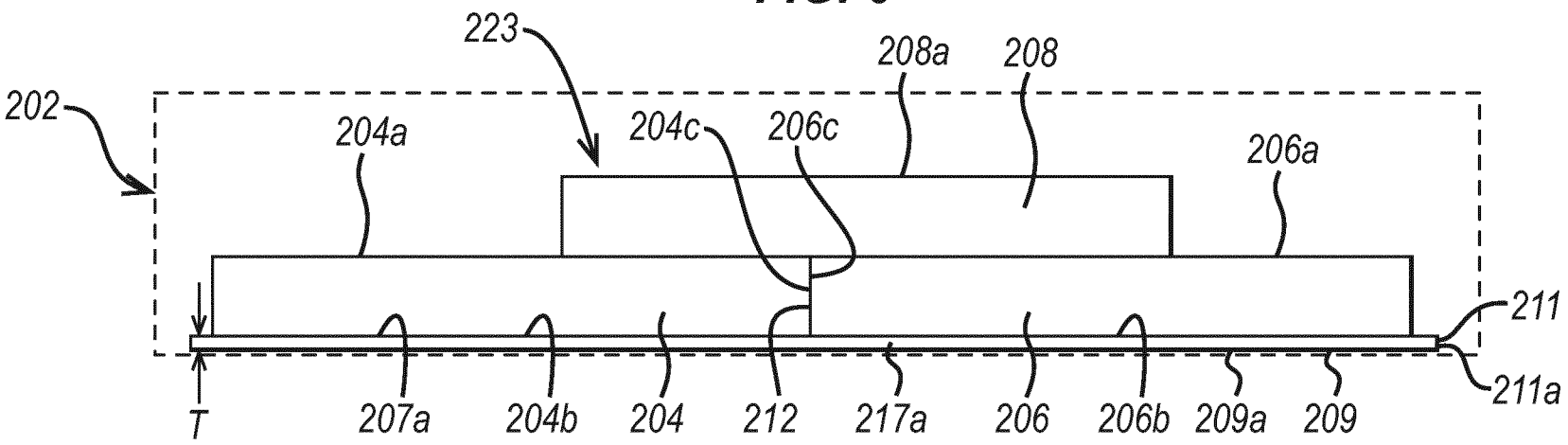
FIG. 6 is side view in the direction of arrow C in FIG. 5.

In FIGS. 5 and 6 there is shown a third information unit 201 in accordance with the invention. The third information unit 201 is adapted in use to be located in, and form an insert to, a container (schematically indicated at 202 in chain-line in FIG. 5) to form a third healthcare product package 210 in accordance with the invention, for instance as described hereinafter with reference to FIG. 10.

The rectangular carrier 203 has a different, in this instance more elongated, aspect ratio (W:L) than the carrier 3 of the first information unit 1. Moreover, in the third information unit 203 the stack 223 comprises two information articles (folded leaflets as before) 204, 206 which are releasably mounted on the front face 207*a* of the carrier 203 (defining the first level of the stack), for example through use of temporary adhesive. In more detail, the mounting of the folded leaflets 204, 206 is such that the bottom faces 204*b*, 206*b* of the folded leaflets 204, 206 are in facing relationship with, and releasably attached to, the carrier front face 207*a*. Moreover, the folded leaflets 204, 206 are arranged on the carrier front face 207*a* so that one of them (folded leaflet 206) is positioned in front of the other one (folded leaflet 204) so that their respective rear 206*c* and front ends 204*c* are either touching, as indicated at 212 in FIG. 5, or in close proximity.

A further information article (folded leaflet) 208 is then mounted in the stack 223 to be superimposed over the other two folded leaflets 204, 206 to bridge or straddle the other two folded leaflets 204, 206 and thus form the second level of the stack 223. The further folded leaflet 208 may be releasably mounted, e.g. through temporary adhesive, to one or both of the other folded leaflets 204, 206.

The stack 223 could be further added to by, for instance by mounting one or more additional folded leaflet to the top surface 208*a* of folded leaflet 208, e.g. in piggyback fashion as described above in respect of the second information unit 101.

The application of temporary adhesive, such as a peelable glue, may be by spotting, as previously described herein.

Figure 7A:
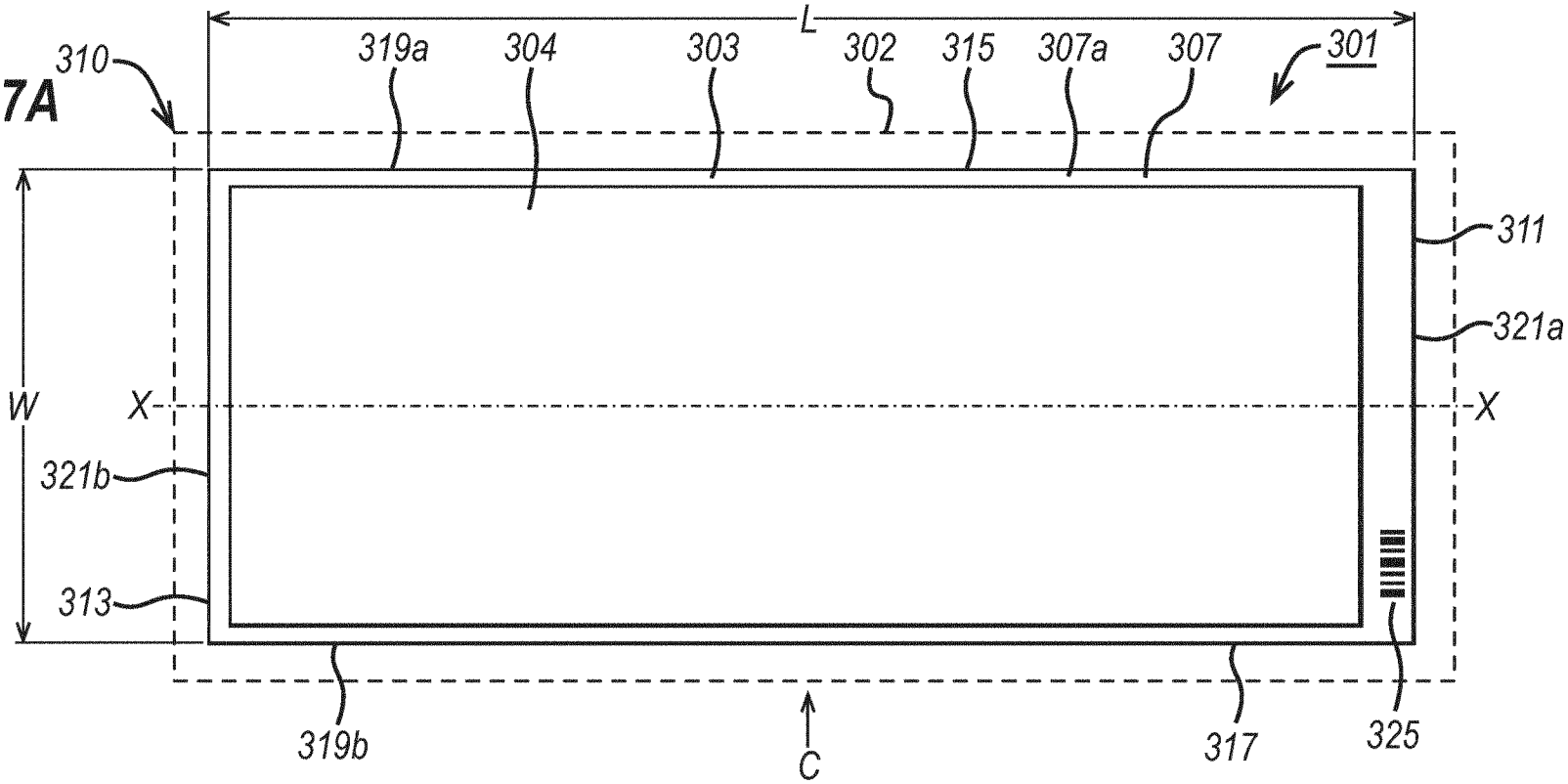
FIG. 7A is a plan view of a fourth information unit/healthcare product package in accordance with the invention.
Figure 7B:
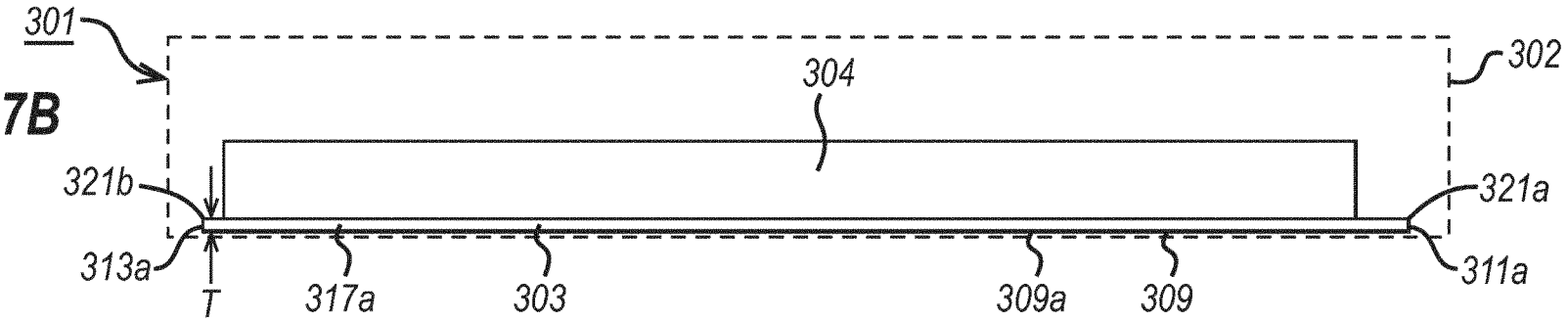
FIG. 7B is a side view on arrow C in FIG. 7A.
Figure 10:
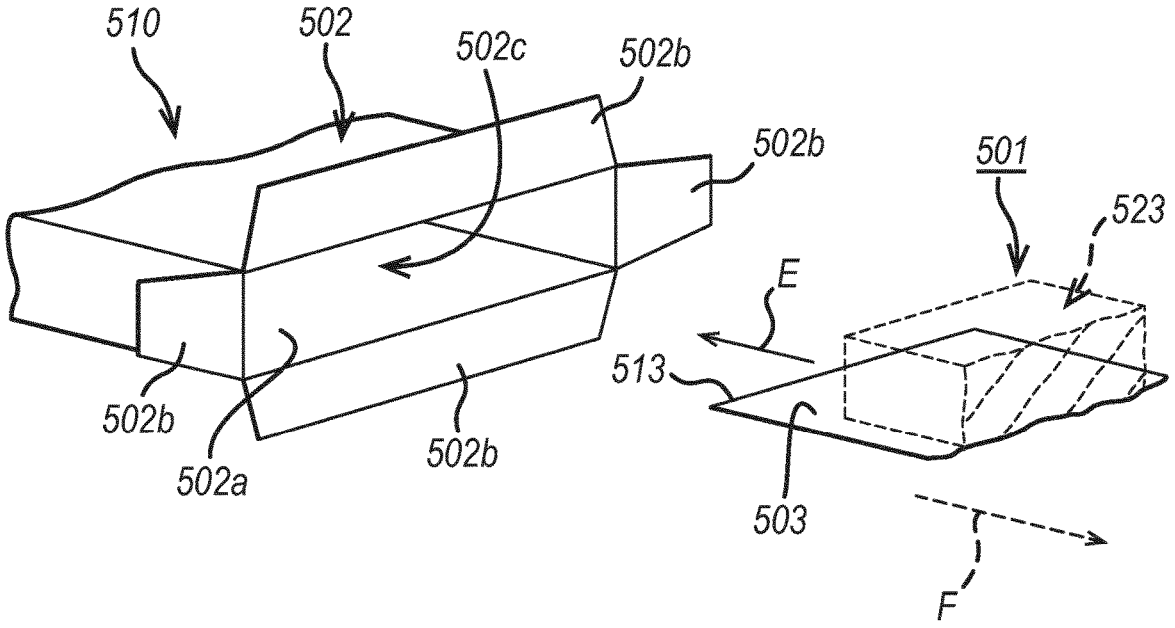
FIG. 10 is an orthogonal, fragmentary view of an information unit in accordance with the invention being inserted into a container to form a sixth healthcare product package in accordance with the invention.

In FIGS. 7A and 7B there is shown a fourth information unit 301 in accordance with the invention adapted in use to be located in, and form an insert to, a container 302 to form a fourth healthcare product package 310 in accordance with the invention, e.g. of the type shown in FIG. 10.

The fourth information unit 301 has only a single information article 304 (e.g. a folded leaflet) mounted on the carrier 307. In a variant (not shown), the land area of the carrier top face 307*a* taken up by the information article 304 may be smaller than shown so that one or more further information articles (e.g. folded leaflets) may be mounted on the free land area of the carrier top face 307*a*, for example in a side-by-side arrangement such as the information articles 204, 206 in the third information unit 201. Thus, there is no stack in the fourth information unit 301.

The information article 304 may be mounted to the carrier top face 307*a* through temporary adhesive (e.g. peelable glue) as has been described previously.

Figure 8:
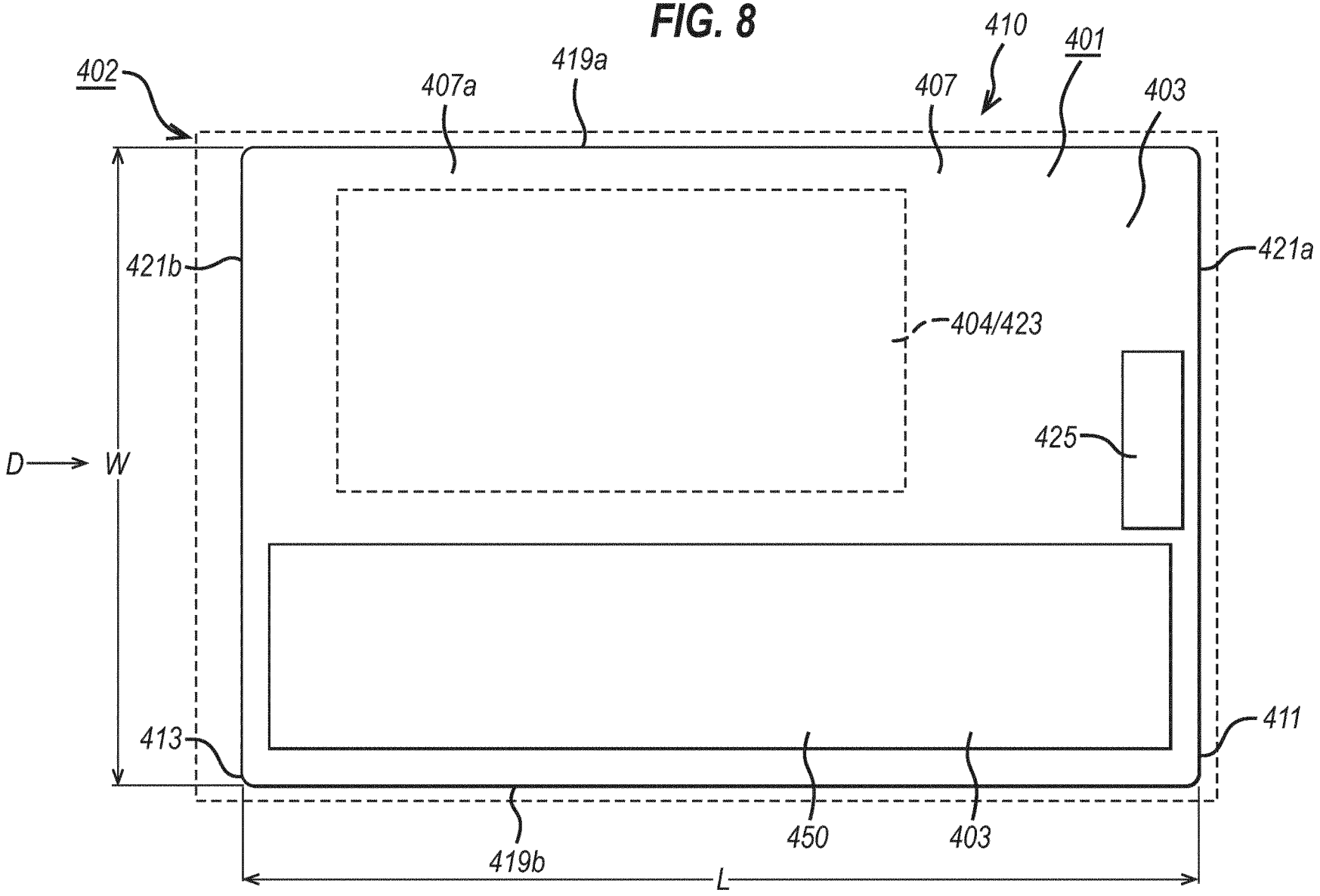
FIG. 8 is a plan view of a fifth information unit/healthcare product package in accordance with the invention.
Figure 9:
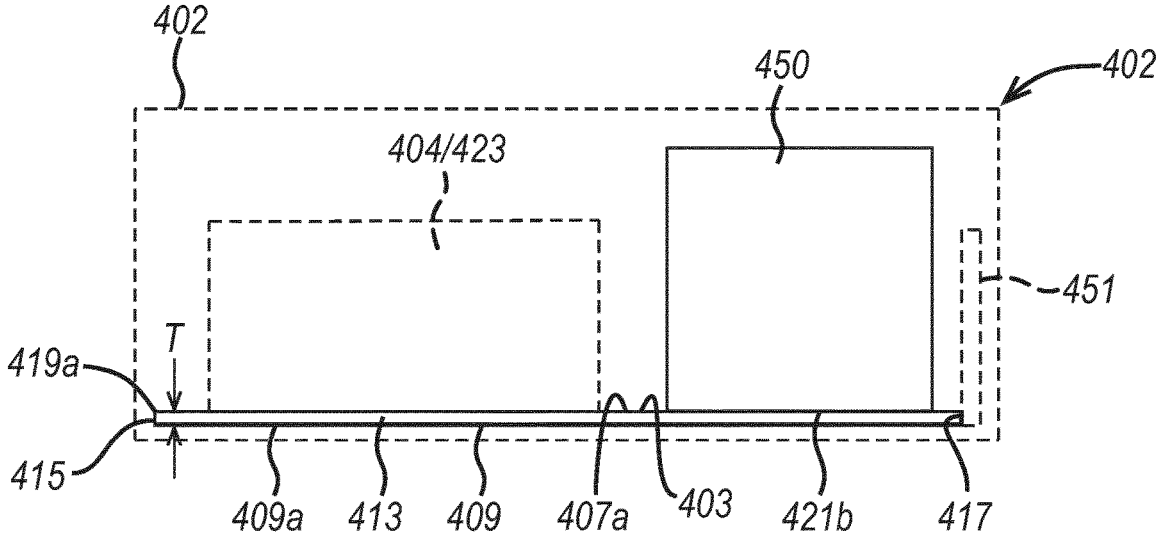
FIG. 9 is a rear view on arrow D in FIG. 8.

In FIGS. 8 and 9 there is shown a fifth information unit 401 in accordance with the invention. The fifth information unit 401 is adapted in use to be located in, and form an insert to, a container (schematically indicated at 402 in chain-line)

to form a fifth healthcare product package 410 in accordance with the invention, for instance as described hereinafter with reference to FIG. 10.

On the rectangular carrier 403 there is provided either a single information article 404 (e.g. a folded information leaflet) or a stack 423 (represented in chain-line). In the variant where there is a stack 423, the stack 423 may be any according to the invention, including the stacks 23; 123; 223 previously disclosed hereinabove.

The principle difference between the fifth information unit 401 and the other information units 1; 101; 201; 301 is that the carrier 403 comprises a free land area to one side of the information article 404 or stack 423 of sufficient size for a healthcare product (schematically represented at 450) to be mounted thereon. Typically, this means a carrier 403 that is wider compared to a carrier used solely for one or more information articles (e.g. folded leaflets), such as the first to fourth information units 1; 101; 201; 301, where the side margins of the carrier are generally in close proximity to the information article(s)/stack(s) to reduce the amount of carrier material used. Thus, the aspect ratio (L:W) of a carrier, such as carrier 403, used to carry one or more information articles (e.g. folded leaflets), whether or not in a stack formation, and a healthcare product on one of its major faces (e.g. top face) will typically be less than that for a carrier used solely for carrying the information article(s)/stack(s).

The healthcare product 450 can rest freely on the top face 407*a* of the land area of the carrier 403 or be releasably fixed thereto, e.g. through one or more ties threaded through apertures in the carrier 403 and tied around the healthcare product 450. As shown in FIG. 9, the carrier 403 may optionally be provided with a side wing 451 (shown in chain-line to indicate its optional presence) along the outer side 417 which can be oriented upwards to prevent the healthcare product 450 slipping sideways off the carrier 403, especially where freely mounted on the land area. Although not shown, it will be understood that a wing could be provided at any one or more of the top end 411, bottom end 413 and opposite side 415 of the carrier 403, either without or, preferably, with the side wing 451. Preferably, where a wing is provided, the healthcare product is 'sandwiched' between the wing and an information article or stack.

In the embodiments described with reference to FIGS. 1 to 9, the carriers 3; 103; 203; 303; 403 are a single, rigid piece of sheet material (in effect a two dimensional (flat) structure, as they have a relatively small thickness T). Other than the provision of one or more peripheral wings, such as described with reference to FIGS. 8 and 9, the sheet material is not provided with any special means (such as fold lines) to enable the carrier to change its size or shape, for example to be extended, such as by unfolding.

In FIG. 10 there is shown an information unit 501 (fragmentary section thereof) in accordance with the invention being inserted into a container 502 (fragmentary section thereof) to form a sixth healthcare product package 510 in accordance with the invention. The information unit 501 may be any in accordance with the invention, for instance any of those described hereinabove with reference to FIGS. 1 to 9 and 11 to 14. The container 502 is pre-formed prior to receipt of the information unit 501. The container 502 in this embodiment is a carton, for instance made from cardboard, coated paper or other material known in the art for forming same, which has been erected and assembled in known manner other than for leaving an opening 502*a*. As indicated by arrow E, the information unit 501 is inserted through the opening 502*a* to be fully inserted into the inner volume or inner space 502*c* of the container 502, whereupon at some future point the opening 502*a* is closed in known manner by moving closure flaps 502*b* into position in the opening 502*a* and joining them together. In this instance, the rear end 513 of the carrier 503 is the leading end of the information unit 501 and the front end (not shown, but see earlier embodiments) is the trailing end (with respect to the direction of insertion), but it could be the other way round of course. The information unit 501 is then fully enclosed in the container 502, along with the healthcare product (not shown) and any other materials which may be needed in the container 502. The information unit 501 is freely located in the container 502; i.e. it is not attached (i.e. fixed) to the container inner surfaces.

Conveniently, the healthcare product is inserted into the container 502 through the same opening 502*a*. If the information unit 501 carries the healthcare product, such as in the fifth information unit 401 supra, then the healthcare product is inserted into the enclosure 402 at the same time. Otherwise, it would be inserted separately. Preferably, the closed opening 502*a* is adapted to be re-opened so that the information unit 501 (and healthcare product) can be removed from the inner space 502*a* of the container 502 in the opposite way (i.e. in the direction of arrow F) to which it was introduced.

However, it is clearly possible for the container 502 to be opened somehow else (e.g. at another end or side of the container 502) to enable removal of the information unit 501/healthcare product through such other opening.

Preferably, the information unit 501 is located in the container 501 so that, when the container 502 is opened, the carrier 503 can be grasped by a user to extract the information unit 501. By way of example, where the opening 502*a* is re-opened, the front end (trailing end) of the carrier 503 is adjacent the opening 502*a* to enable it to be grasped by a user with their fingers and the information unit 501 pulled out of the opening 502*a*. Alternatively, the rear end 513 (leading end) of the carrier 503 is adjacent an opening (not shown) on the side of the container 502 opposite to that in which the opening 502*a* is formed. When that other opening is opened, the information unit 501 can be pulled out of the container 502 through that other opening by grasping the carrier rear end 513 with fingers. Ideally, the carrier end for grasping is the one at any machine readable unique ID or code (not shown, but see other embodiments) is provided at to enable it to be interrogated whilst in situ in the container, as the need arises.

In FIGS. 11 to 14 there are various further embodiments of carrier that can be used in the present invention. Moreover, without limitation, each embodiment of the invention disclosed (both generally and specifically) with reference to FIGS. 1 to 10 may be modified by substitution of the carrier 3; 103; 203; 303; 403; 503 thereof with any one of the carriers hereinafter to be described with reference to FIGS. 11 to 14. To avoid unnecessary repetition, like reference numerals will be used for those features of the carries of FIGS. 11 to 14 which are common with the carriers 3; 103; 203; 303; 403; 503 previously described with reference to FIGS. 1 to 10.

Figure 11:
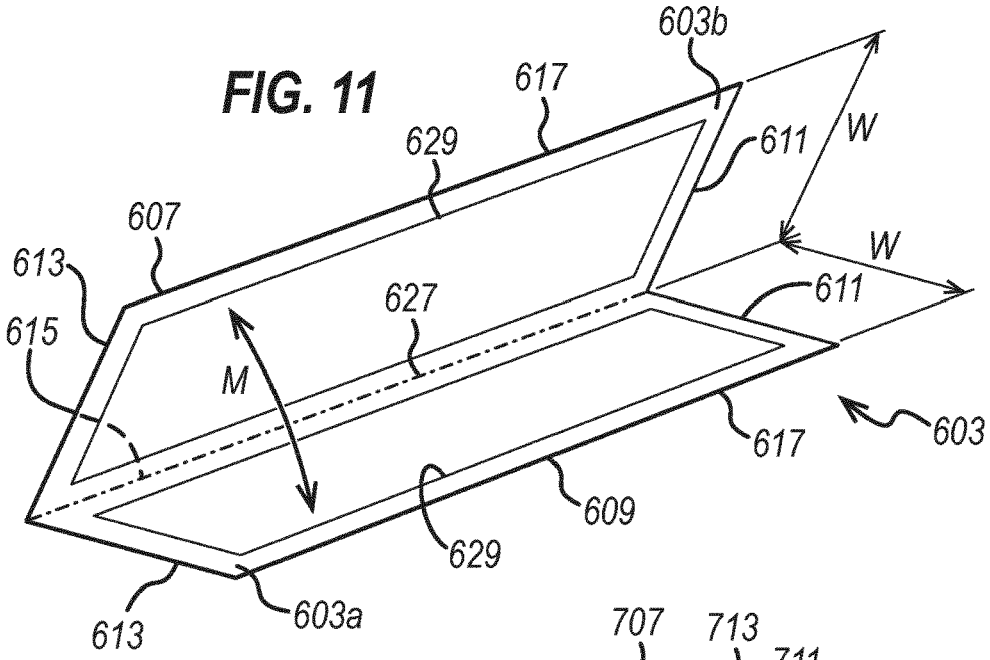
FIG. 11 is an orthogonal view of a first extendible carrier for use in the invention.

FIG. 11 shows a carrier 603 which differs from those of FIGS. 1 to 10 in that it is movable between collapsed and extended states, as indicated by the double-headed arrow M. In this instance the carrier 603 is twice the size desired for its function in an information unit to carry and locate the associated information article(s) in a container. However, the carrier 603 is provided with a single fold line 627 which extends from the front end 611 to the rear end 613 to bisect the carrier 603 into two carrier panels 603*a*,603*b* (here, equal halves; widths W and lengths (not labelled) are the same) and about which the carrier 603 can be moved from/to an extended (unfolded) state, in which the carrier 603 is laid out flat (where the carrier panels 603*a*, 603*b* are (substantially) co-planar), to/from a collapsed (folded) state, in which the carrier 603 is folded up so that the carrier panels 603*a*, 603 are in an overlying or stacked relationship.

As will be appreciated, in the folded state the carrier panels 603*a*, 603*b* will be in an opposing face-to-face relationship with one of the carrier panels 603*a* being topmost (thus presenting the top 607 of the carrier 603) and the other carrier panel 603*b* being bottommost (thus defining the bottom 609 of the carrier 603). Moreover, the carrier panels 603*a*, 603*b* may be maintained in the folded state through a releasable attachment between the opposed facing surfaces of the carrier panels 603*a*, 603*b*, examples being a temporary adhesive as mentioned previously hereinabove for other embodiments of the invention. These opposed facing carrier surfaces are the inner surfaces of the carrier 603 in its collapsed (folded) state.

In the collapsed state of the carrier 603, its footprint (substantially) corresponds to that of a carrier formed by just one of the carrier panels 603*a*, 603*b*. Moreover, the total surface area of the carrier 603 is twice as great as that presented by a carrier corresponding in shape and size to just one of the carrier panels 603*a*, 603*b*. As a practical example, replacing the previous carriers 3; 103; 203; 303; 403; 503 with a carrier 603 whose carrier panels 603*a*, 603*b* each correspond in shape and size to that previous carrier means that the total surface area of the carrier 603 is twice that of the one it has replaced, without affecting its primary function to carry and locate the information article(s) in the container.

An advantage of this comparatively greater total surface area is that this forms the outer surface of the carrier 603 when it is extended (unfolded). In other words, the inner surfaces of the carrier 603 when in its collapsed state become outer surfaces in the extended state. Or expressed yet another way, both sides of each panel 603*a*, 603*b* form an outer surface in the extended state. Consequently, the extended state of the carrier 603 provides much more potentially usable surface area than a comparable carrier corresponding in footprint to just one of the panels 603*a*, 603*b* (e.g. one of the 'single panel' carriers 3; 103; 203; 303; 403; 503).

One use for the extra surface area provided by the carrier 603 in its extended state is to additionally use the carrier 603 to carry more information for the user of the healthcare product, noting that it will be a straightforward matter for the user (or someone else) to open the carrier 603 to its extended state (either with or without the information article(s) firstly removed) after the carrier is removed from the container. As an example, the carrier 603 may form a quickstart guide for the healthcare product or an aspect thereof, for instance how to use a delivery device if there is one (e.g. pre-filled syringe or (auto)injector, as described elsewhere herein). The additional information can be provided on one or both surfaces of one or both panels 603*a*, 603*b*. By way of example only, FIG. 11 represents the areas in which information is provided at 629. It will be appreciated that information can be presented on the top and/or bottom surfaces 607, 609; this could of course require the user (or someone else) to remove the information article(s) first.

Figure 12:
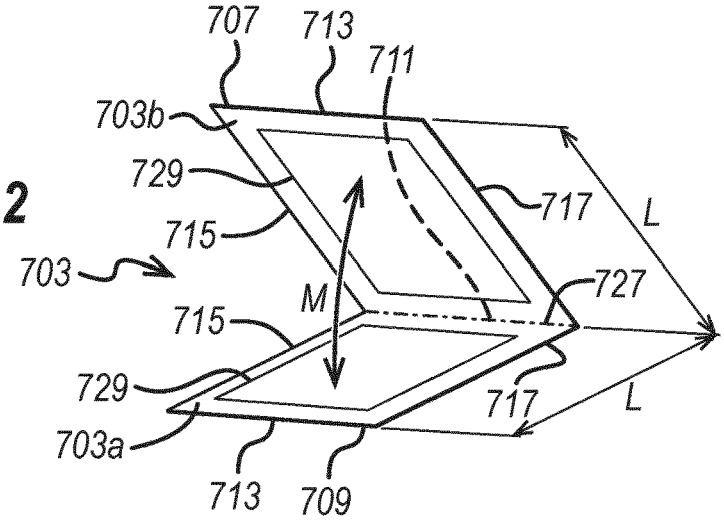
FIG. 12 is an orthogonal view of a second extendible carrier for use in the invention.

The carrier 703 shown in FIG. 12 is identical to that of FIG. 11 other than the fold line 727 extends laterally from one longitudinal side to the other. Again, the fold line 727 bisects the carrier 703 into two equal halves 703*a*, 703*b* (the widths (not labelled) and the lengths L are equal) which can be folded to overlie.

Figure 13:
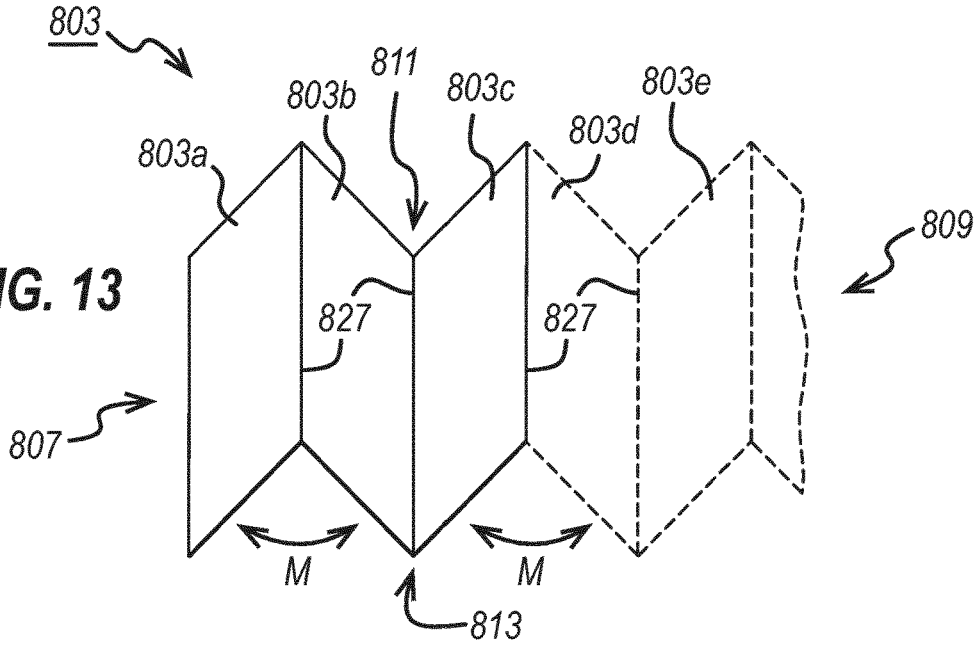
FIG. 13 is an orthogonal view of a third extendible carrier for use in the invention.

In FIG. 13 there is shown a carrier 803 which is similar to carriers 603; 703 in that it is movable between extended (unfolded) and collapsible (folded) states, but it comprises more than two carrier panels 803*a-e* in series to form a concertina arrangement. In this instance, the carrier comprises three carrier panels 803*a-c* of the same shape and size, but the chain line indicates that in variants it can have one or more further such carrier panels 803*d-e*. As can be seen, the carrier 803 is provided with plural, (substantially) parallel fold lines 827, here extending from the front end 811 to the rear end 813, to divide the carrier 803 into the carrier panels. As before, the carrier 803 can be collapsed (folded up), as shown by arrows M, to a collapsed (folded) state with a footprint which corresponds to that of each of the carrier panels. This arrangement can provide even more surface area than the two panel arrangements supra, e.g. to allow more information to be presented by this type of carrier 803, e.g. if used as a quickstart guide. The number of extra panels needed compared to the two panel arrangements will depend on how much extra outer surface (e.g. for information) is required.

Figure 14B:
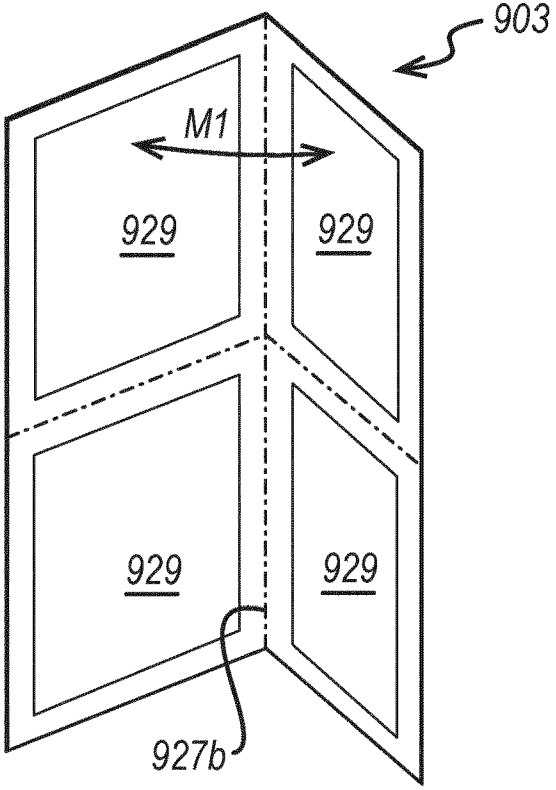
FIGS. 14A to 14E are orthogonal views of a fourth extendible carrier for use in the invention, showing how the carrier can be moved from an extended state (FIG. 14A) to a collapsed state (FIG. 14E).
Figure 14A:
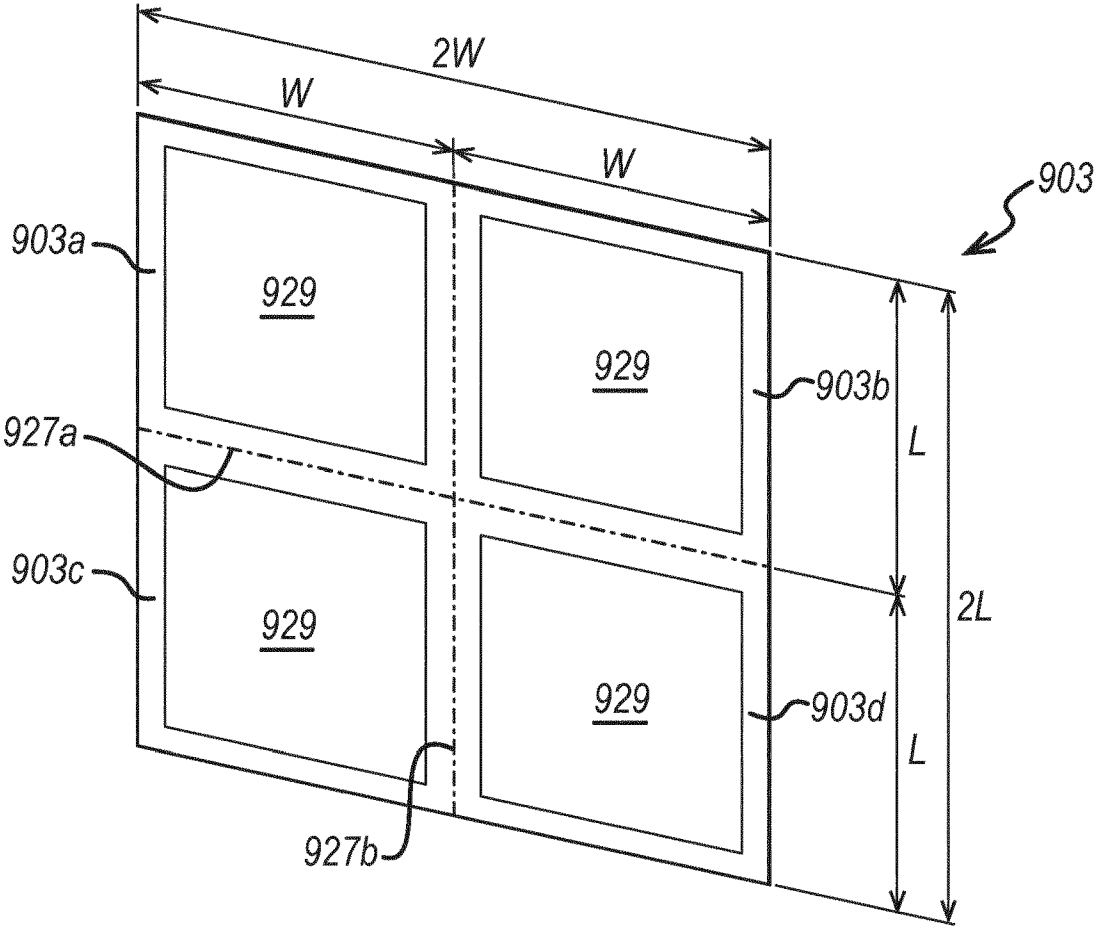
Figure 14C:
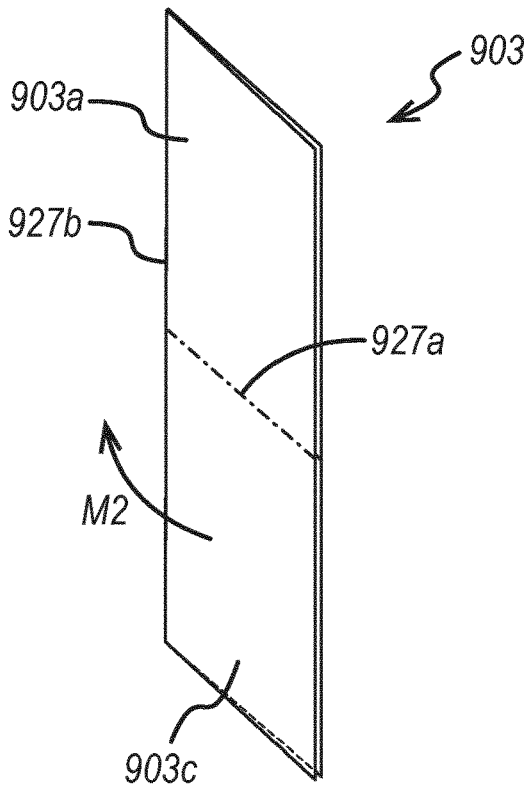
Figure 14D:
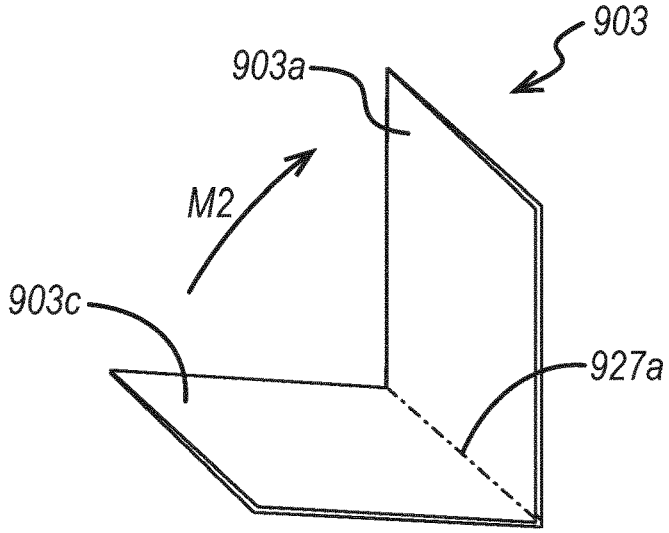
Figure 14E:
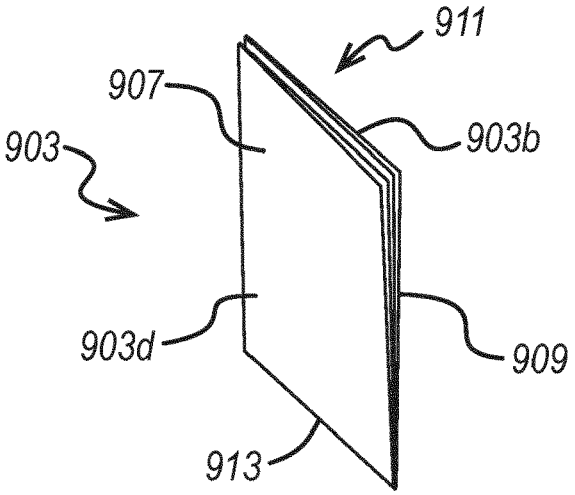

A further extendible carrier 903 is shown in FIGS. 14A-E. This carrier 903 is similar to the other extendible carriers 603; 703; 803 in that it can be moved between an extended (unfolded) state (FIG. 14A) to a collapsed (folded) state (FIG. 14E). However, the carrier 903 has two fold lines 927*a*, 927*b* oriented (substantially) perpendicularly to one another and extending between opposing ends so as to divide the carrier 903 into four carrier panels (quarters) 903*a-d* of the same size (width W and length L) and the same shape (square or rectangular). The folding action is shown by the arrows M1, M2.

The extendible carriers 603; 703; 803; 903 have the following attributes in common:—

- Like the previous 'single panel' carriers 3; 103; 203; 303; 403; 503, they are formed from a planar sheet (a blank; in effect a two-dimensional (flat) material). They may be made from the same materials and have the same material properties as previously described for the carrier element of the invention, in particular the previous carriers 3; 103; 203; 303; 403; 503.
- Following from the preceding point, the carriers 603; 703; 803; 903 are formed from a blank of a single, rigid piece of sheet (in effect two dimensional (flat)) material) which is provided with fold lines to enable the sheet to be folded up ready for use in carrying and locating the at least one information article in a container. Notwithstanding the fold lines, such carriers are still sufficiently stiff for reliable automated insertion into the container.
- With the carrier in its collapsed (folded) state, at least one information article may be mounted on it, for example in one of the manners hereinabove described with reference to FIGS. 1 to 10.
- The carrier in its folded state may carry an accessory in between opposed facing surfaces thereof (which define a pocket of sorts). As an example, where the healthcare product comprises a syringe or (auto)injector, the accessory may be one or more swabs to wipe the intended injection site on human or animal tissue.
- The fold lines can be formed in any manner know in the packaging art.
- One or more of the fold lines can be such as to allow one of more of the carrier panels to be detached from the carrier. For instance, the fold lines are formed as lines of weakness, an example being a perforation line. This variant may be used to separate the carrier panel on which the at least one information article is attached from the other panel(s) on which the information for the quickstart guide is provided. This variation may be applied to all embodiments of the extendible carrier disclosed herein.

The footprint of the carrier in its collapsed state (and thus of the carrier panels) is a quadrilateral selected from rectangular and square, typically rectangular as for the carriers of FIGS. 1 to 10. The footprint of the carrier in its extended state is also such a quadrilateral.

The carrier may be held in its collapsed state through use of a releasable attachment between the panels, examples for such releasable attachment being described hereinabove.

Typically, the at least one information article is mounted to the top 607; 707; 807 of the extendible carrier, to correspond to the non-extendible carriers of FIGS. 1 to 9. However, in variations the at least one information article may be mounted (sandwiched) on the carrier between opposed facing surfaces of the carrier panels in the collapsed state (e.g. releasably attached to an inner surface or simply held in place between carrier panels).

Having regard to the extendible carriers described hereinabove with reference to FIGS. 11 to 14, the carrier described with reference to FIGS. 1 to 10 can be considered as consisting of a single carrier panel.

The illustrated embodiments may further be understood by recourse to the related details given in the Summary of the Invention section hereinabove, which related details can be read into the detailed description of the illustrated embodiments.

It will be apparent that each illustrated embodiment of the invention could be modified in various ways within the scope of the invention.

For instance, the illustrated embodiments may be modified to include, as addition or replacement, any one or more features of the other embodiments which are described in the Summary of the Invention or with reference to the FIGURES of drawings.

Moreover, the illustrated embodiments can be implemented with dimensions and arrangements in proportion to what is shown in the FIGURES of drawings.

What is claimed is:

1. A healthcare product package comprising:

(a) a container containing a healthcare product, and (b) an information unit which is located inside the container, wherein the information unit comprises a carrier and at least two information articles attached to the carrier, wherein each of the at least two information articles is a leaflet which is in a folded-up state, wherein the at least two information articles are releasably attached to a common side of the carrier and arranged in a stack, and wherein the information unit does not include means enclosing the at least two information articles.

2. The product of claim 1, wherein the carrier is a base card or backing card.

3. The product of claim 1, wherein the carrier has a length in the range of 100-200 mm.

4. The product of claim 1, wherein the carrier has a width in the range of 50-80 mm.

5. The product of claim 1, wherein the carrier has a thickness in the range of 0.1-2 mm.

6. The product of claim 1, wherein the carrier has an end which is located adjacent an opening of the container.

7. The product of claim 1, wherein the at least two information articles are made from paper.

8. The product of claim 1, wherein the information articles or at least one of the information articles provides information about the healthcare product.

9. The product of claim 8, wherein the information concerns user instructions, safety information or product characteristics.

10. The product of claim 1, wherein the healthcare product is a pharmaceutical product and the at least two information articles contain& information about the pharmaceutical product.

11. The product of claim 10, wherein the at least two information articles comprise any one or more of a Patient Information Leaflet, a Doctor's Information Leaflet and an Instructions for Use, each containing information concerning the pharmaceutical product.

12. The product of claim 10, wherein the pharmaceutical product is a pre-filled delivery device.

13. The product of claim 1, wherein the container is a box or a carton.

14. The product of claim 1, wherein the healthcare product is mounted to the carrier.

15. The product of claim 1, wherein the information unit consists only of the carrier and the information articles as component parts.

16. The product of claim 1, wherein the carrier is in a collapsed state and movable to an extended state.

17. The product of claim 16, wherein the carrier is a quickstart guide.

18. A healthcare product package comprising:

(a) a container containing a healthcare product, and (b) an information unit which is located inside the container, wherein the information unit comprises a carrier and at least two information articles attached to the carrier, wherein each of the at least two information articles is a leaflet which is in a folded-up state, wherein the at least two information articles are releasably attached to a common side of the carrier and arranged in a stack, wherein the information unit does not include means enclosing the at least two information articles; and wherein the common side of the carrier is a top side, wherein a first one of the at least two information articles is a bottommost information article in the stack and is releasably attached to the top side of the carrier, and wherein a second one of the at least two information articles is a topmost information article in the stack and is releasably attached to a top side of the information article in the stack immediately behind it.

19. The product of claim 18, wherein the stack includes at least one additional said information article, wherein the at least one additional information article is an intermediate information article in the stack which is sandwiched between the topmost and bottommost information articles, and wherein each intermediate information article is releasably attached to the information article behind it in the stack and supports the information article in the stack atop it.

20. A healthcare product package comprising:

(a) a container containing a healthcare product, and (b) an information unit which is located inside the container, wherein the information unit comprises a carrier and at least two information articles attached to the carrier, wherein each of the at least two information articles is a leaflet which is in a folded-up state, wherein the at least two information articles are releasably attached to a common side of the carrier and arranged in a stack, wherein the information unit does not include means enclosing the at least two information articles; wherein the common side of the carrier is a top side, and wherein a first one of the at least two information articles is releasably attached to the top side of the carrier and a second one of the at least two information articles is releasably attached to a top side of the first information article.

21. A healthcare product package comprising:

(a) a container containing a healthcare product, and (b) an information unit which is located inside the container, wherein the information unit comprises a carrier and at least two information articles attached to the carrier, wherein each of the at least two information articles is a leaflet which is in a folded-up state, wherein the at least two information articles are releasably attached to a top side of the carrier and arranged in a stack, wherein the information unit does not include means enclosing the at least two information articles; and wherein the top side of the carrier presents a top face of the carrier, the first and second information articles each have a bottom face and a top face, the releasable attachment of the first information article to the carrier top side attaches the bottom face of the first information article to the top face of the carrier, and the releasable attachment of the second information article to the carrier top side attaches the bottom face of the second information article to the top face of the first information article.

22. The product of claim 21, wherein the healthcare product comprises a delivery device selected from the group consisting of a syringe, injector and autoinjector.

23. The product of claim 22, wherein one of the at least two information articles comprises instructions for use of the delivery device.

24. The product of claim 21, wherein the releasable attachment of the first information article to the carrier and of the second information article to the first information article is a temporary adhesive connecting the respective top and bottom faces.

25. The product of claim 24, wherein the temporary adhesive connecting the respective top and bottom faces has the form of at least one zone of temporary adhesive.

26. The product of claim 25, wherein the at least one zone is at least one spot.

* * * * *